US010920979B2

(12) United States Patent
Zink et al.

(10) Patent No.: US 10,920,979 B2
(45) Date of Patent: Feb. 16, 2021

(54) LOW NOX BURNER AND FLOW MOMENTUM ENHANCING DEVICE

(71) Applicant: ZEECO, INC., Broken Arrow, OK (US)

(72) Inventors: Darton J. Zink, Tulsa, OK (US); Rex K. Isaacs, Collinsville, OK (US); John Petersen, Pawnee, OK (US); Cody Little, Coweta, OK (US); Tim Kirk, Morris, OK (US)

(73) Assignee: ZEECO, INC., Broken Arrow, OK (US)

( * ) Notice: Subject to any disclaimer, the term of this patent is extended or adjusted under 35 U.S.C. 154(b) by 8 days.

(21) Appl. No.: 15/946,777

(22) Filed: Apr. 6, 2018

(65) Prior Publication Data

US 2019/0309942 A1 Oct. 10, 2019

(51) Int. Cl.
*F23D 14/02* (2006.01)
*F23D 14/70* (2006.01)

(52) U.S. Cl.
CPC ..... *F23D 14/02* (2013.01); *F23D 14/70* (2013.01)

(58) Field of Classification Search
CPC ..... F23D 11/402; F23D 14/70; F23C 9/006; F23G 7/085; F23G 7/08; F23G 7/06; F23G 7/065
See application file for complete search history.

(56) References Cited

U.S. PATENT DOCUMENTS

| | | | | |
|---|---|---|---|---|
| 3,817,685 | A * | 6/1974 | Joannes | F23D 11/402 431/116 |
| 3,905,755 | A | 9/1975 | Aske | |
| 5,134,985 | A | 8/1992 | Rao | |
| 5,458,481 | A | 10/1995 | Surbey et al. | |
| 5,542,840 | A | 8/1996 | Surbey et al. | |
| 5,799,594 | A | 9/1998 | Dernjatin et al. | |
| 5,980,243 | A | 11/1999 | Surbey et al. | |
| 6,089,170 | A | 7/2000 | Conti et al. | |
| 6,394,792 | B1 | 5/2002 | McDonald et al. | |
| 6,499,990 | B1 | 12/2002 | Zink et al. | |
| 6,626,661 | B1 | 9/2003 | Zink et al. | |
| 7,670,135 | B1 | 3/2010 | Zink et al. | |
| 2002/0197574 | A1 * | 12/2002 | Jones | F23C 6/047 431/8 |

(Continued)

FOREIGN PATENT DOCUMENTS

| | | | | |
|---|---|---|---|---|
| DE | 3628293 | A1 * | 2/1988 | F23C 9/006 |

OTHER PUBLICATIONS

PCT/US2019/025508; Corrected International Search Report and Written Opinion; dated Apr. 3, 2019; US.

*Primary Examiner* — Jason Lau
(74) *Attorney, Agent, or Firm* — Dennis D. Brown; Brown Patent Law, P.L.L.C.

(57) ABSTRACT

A flow momentum enhancing device having an airfoil shape is used in a new or refurbished burner to increase the momentum of the burner combustion air stream and create a reduced pressure region which pulls inert products of combustion into the combustion process. The inert products of combustion mix with the burner air and/or fuel streams to lower the peak flame temperature of the burner and provide reduced $NO_x$ production.

32 Claims, 16 Drawing Sheets

(56) References Cited

U.S. PATENT DOCUMENTS

| | | | | |
|---|---|---|---|---|
| 2006/0105276 | A1* | 5/2006 | Wilkins | F23G 7/08 431/5 |
| 2007/0292811 | A1* | 12/2007 | Poe | F23D 14/84 431/116 |
| 2013/0122440 | A1 | 5/2013 | Zink et al. | |
| 2013/0230811 | A1 | 9/2013 | Goodson et al. | |
| 2014/0065558 | A1 | 3/2014 | Colannino et al. | |
| 2015/0211735 | A1* | 7/2015 | Menger | F23G 7/08 431/5 |

* cited by examiner

LOW NOX BURNER AND FLOW MOMENTUM ENHANCING DEVICE

FIELD OF THE INVENTION

The present invention relates to burner apparatuses and methods for reducing $NO_x$ emissions from heaters, boilers, incinerators, other fired heating systems, flares, and other combustion systems of the type used in refineries, power plants, and chemical plants, on offshore platforms, and in other industrial services and facilities.

BACKGROUND OF THE INVENTION

A continuing need exists for burners, burner combustion methods, add-ons for new and refurbished burners, and burner refurbishing methods which will significantly reduce $NO_x$ emissions from fired heaters, boilers, incinerators, flares and other combustion systems used in industrial processes. The improved new and refurbished burners will also preferably provide flame lengths, turndown ratios, and stability levels which are at least as good as or better than those provided by the current burner designs.

For burners which are used in industrial applications, if the burner fuel is thoroughly mixed with air and combustion occurs under ideal conditions, the resulting combustion products are primarily carbon dioxide and water vapor. However, when the fuel is burned under less than ideal conditions, e.g., at a high flame temperature, nitrogen present in the combustion air reacts with oxygen to produce nitrogen oxides ($NO_x$). Other conditions being equal, $NO_x$ production increases as the temperature of the combustion process increases. $NO_x$ emissions are generally considered to contribute to ozone depletion, acid rain, smog, and other environmental problems.

For gaseous fuels with no fuel bound nitrogen, thermal $NO_x$ is the primary mechanism for $NO_x$ production. Thermal NO is produced when the flame reaches a high enough temperature to break the covalent $N_2$ bond so that the resulting "free" nitrogen atoms bond with oxygen to form $NO_x$.

Typically, the temperature of combustion is not great enough to break all of the $N_2$ bonds. Rather, most of the nitrogen in the air stream passes through the combustion process and remains as diatomic nitrogen ($N_2$) in the combustion products. However, some of the $N_2$ will typically reach a high enough temperature in the high intensity regions of the flame to break the $N_2$ bond and form "free" nitrogen. Once the covalent nitrogen bond is broken, the "free" nitrogen is available to bond with other atoms. Fortunately, the free nitrogen will most likely react with other free nitrogen atoms to form $N_2$. However, if another free nitrogen atom is not available, the free nitrogen will react with oxygen to form $NO_x$.

As the temperature of the burner flame increases, the stability of the $N_2$ covalent bond decreases, causing increasing production of free nitrogen and thus also increasing the production of thermal $NO_x$ emissions. Consequently, in an ongoing effort to reduce $NO_x$ emissions, various types of burner designs and theories have been developed with the objective of reducing the peak flame temperature.

The varied requirements of refining, power generation, petrochemical processes, and other processes necessitate the use of numerous different types and configurations of burners. The approaches used to lower $NO_x$ emissions can differ from application to application. However, thermal $NO_x$ reduction is generally achieved by slowing the rate of combustion. Since the combustion process is a reaction between oxygen and the burner fuel, the objective of delayed combustion is typically to reduce the rate at which the fuel and oxygen mix together and burn. The faster the oxygen and the fuel mix together, the faster the rate of combustion and the higher the peak flame temperature.

Examples of different types of burner design approaches used for reducing $NO_x$ emissions have included:

(a) Staged air designs wherein the combustion air is typically separated into two or more flows to create separate zones of lean and rich combustion.

(b) Designs using Internal Flue Gas Recirculation (IFGR) wherein internal flow momentum is used to cause some of the flue gas (i.e., the inert products of combustion) in the combustion system to recirculate back into the combustion zone to form a diluted combustion mixture which burns at a lower peak flame temperature.

(c) Staged fuel designs wherein (i) all or part of the fuel is introduced outside of the combustion air stream so as to delay mixing the fuel with the combustion air stream, creating a fuel-air mixture which burns at a lower peak flame temperature or (ii) part of the fuel is introduced outside of the primary flame envelope to stage the flame and combust the fuel in the presence of the products of combustion from the primary flame.

(d) Designs using External Flue Gas Recirculation (EFGR) wherein the burner typically uses an external air blower which supplies combustion air to the burner and also includes an external piping arrangement which draws flue gas from the combustion chamber into the suction of the blower. This flue gas mixes with the combustion air stream to reduce the oxygen concentration of the air stream supplied to the burner, which in turn lowers the peak flame temperature.

(e) Designs using "flameless" combustion wherein most, or all, of the burner fuel passes through and mixes with inert products of combustion to form a diluted fuel which burns at a lower peak flame temperature. The mixture of fuel and inert products of combustion can be as high as 90% inert, thus resulting in a "transparent" flame.

(f) Designs using steam and/or inert injection into the burner fuel wherein the steam or inert component mixes with the fuel so that the resulting composition will burn at a lower peak flame temperature.

(g) Designs using steam and/or inert injection into the combustion air stream wherein the steam and/or inert components mix with the combustion air so that the resulting composition will burn at a lower peak flame temperature.

(h) Designs using high excess air levels to dilute products of combustion and produce low flame temperatures, such as surface stabilized combustion burners.

SUMMARY OF THE INVENTION

The present invention provides a low $NO_x$ burner apparatus, and a device and method for enhancing flow momentum, which satisfy the needs and alleviate the problems discussed above. The inventive device and method for enhancing flow momentum can be installed on or in most types of burners used in fired heaters, boilers, incinerators, enclosed flares, and in similar industrial services, as well as in pilot burners and other types of combustion systems.

When used on or in a new or refurbished burner, the inventive device and method operate to significantly increase the flow momentum of a stream of combustion air, or a mixture of combustion air and fuel, traveling through the burner and to create a low pressure region which pulls an increased amount of the surrounding inert products of combustion (flue gas) present in the combustion system into the burner combustion mixture. Consequently, the inventive device and method are capable of significantly lowering the peak flame temperature of the burner, thus leading to reduce NOx emissions, by maximizing the amount of internal flue gas recirculation (IFGR) which occurs in the burner combustion process.

Moreover, in addition to increasing the amount of IFGR which occurs in the burner combustion process, the inventive device and method operate to mix the increased amount of recirculated flue gas with the burner combustion mixture in a more efficient manner which also decreases the burner flame length and reduces CO emissions, particulate emissions, VOC emissions, unburned hydrocarbon emissions, and the emission of other hazardous air pollutants.

The device and method for enhancing flow momentum will typically reduce thermal $NO_x$ emissions from the inventive burner by approximately 60%. The inventive device and method are capable of mixing up to 2.5 pounds of inert internal products of combustion (flue gas) with each pound of the burner fuel/air combustion mixture.

In one aspect, there is provided a burner apparatus which preferably comprises: (a) a burner wall having a forward longitudinal end; (b) an air flow passageway, which extends through and is surrounded by the burner wall, for a combustion air stream comprising air or a mixture of air and fuel which travels through the air flow passageway, the air flow passageway having a forward discharge opening at the forward longitudinal end of the burner wall, and the forward discharge opening having an internal diameter or width; and (c) a flow momentum enhancing device having a longitudinal axis, a rearward longitudinal end, a forward longitudinal end, and a surrounding exterior surface which extends from the rearward longitudinal end to the forward longitudinal end of the flow momentum enhancing device. The exterior surface of the flow momentum enhancing device has a maximum lateral outside diameter or width at a location which is rearward of the forward longitudinal end the flow momentum enhancing device. The exterior surface of the flow momentum enhancing device has an outside diameter or width at the forward longitudinal end of the flow momentum enhancing device which is less than the maximum lateral outside diameter or width.

The rearward longitudinal end of the flow momentum enhancing device is positioned in the air flow passageway, at the forward discharge opening of the air flow passageway, or forwardly of the air flow passageway so that a flow path is defined outside of the flow momentum enhancing device for a flow path stream which comprises all or a portion of the combustion air stream which travels through the air flow passageway. The flow path for the flow path stream travels over and in contact with the maximum lateral outside diameter or width of the exterior surface and then continues to travel along and in contact with the exterior surface from the location of the maximum lateral outside diameter or width to the forward longitudinal end of the flow momentum enhancing device such that, as the flow path for the flow path stream approaches the forward longitudinal end of the exterior surface, the exterior surface, and the flow path for the flow path stream traveling along and in contact with the exterior surface, converge inwardly, preferably in a straight or curving manner, with respect to the longitudinal axis of the flow momentum enhancing device.

The flow momentum enhancing device used in the inventive burner apparatus can also have an interior passageway which extends longitudinally therethrough and defines an interior flow path for the device. As seen in a longitudinal cross-sectional view, the wall of the flow momentum enhancing device which surrounds the interior passageway will preferably have (a) a non-symmetrical wing airfoil shape, (b) a conical or other straight converging exterior shape with a cylindrical interior passageway, (c) a symmetrical wing airfoil shape, or (d) other airfoil shape.

In another aspect, there is provided a burner apparatus which preferably comprises: (a) a burner wall having a forward longitudinal end; (b) an air flow passageway, which extends through and is surrounded by the burner wall, for a combustion air stream comprising air or a mixture of air and fuel which travels through the air flow passageway, the air flow passageway having a forward discharge opening at the forward longitudinal end of the burner wall; and (c) a flow momentum enhancing device having a longitudinal axis, a rearward longitudinal end, a forward longitudinal end, and an interior passageway which extends longitudinally through the flow momentum enhancing device from the rearward longitudinal end to the forward longitudinal end of the flow momentum enhancing device. The flow momentum enhancing device further comprises a device wall which surrounds the interior passageway of the flow momentum enhancing device and extends from the rearward longitudinal end to the forward longitudinal end of the flow momentum enhancing device. The device wall has (i) an exterior surface which extends from the rearward longitudinal end to the forward longitudinal end of the flow momentum enhancing device and (ii) an interior surface, for the interior passageway, which extends from the rearward longitudinal end to the forward longitudinal end of the flow momentum enhancing device. The exterior surface of the device wall has a maximum lateral outside diameter or width at a location which is rearward of the forward longitudinal end of the flow momentum enhancing device. The exterior surface of the device wall has an outside diameter or width at the forward longitudinal end of the flow momentum enhancing device which is less than the maximum lateral outside diameter or width. The rearward longitudinal end of the flow momentum enhancing device is positioned in the air flow passageway, at the forward discharge opening of the air flow passageway, or forwardly of the air flow passageway. The interior passageway of the flow momentum enhancing device defines a flow path through the flow momentum enhancing device for a flow path stream which comprises all or a portion of the combustion air stream which travels through the air flow passageway.

In another aspect, there is provided a method of reducing $NO_x$ emissions from a burner apparatus comprising the steps of: (a) delivering a combustion air stream comprising air or a mixture of air and fuel through an air flow passageway which is surrounded by a burner wall of the burner apparatus, the burner wall having a forward longitudinal end, the air flow passageway having a forward discharge opening at the forward longitudinal end of the burner wall, and the forward discharge opening having an internal diameter or width and (b) causing a flow stream comprising all or a portion of the combustion air stream flowing through the air flow passageway to flow along and in contact with a surrounding exterior surface of a flow momentum enhancing device wherein (i) the flow momentum enhancing device has a longitudinal axis, (ii) the flow momentum enhancing device has a rearward longitudinal end which is positioned in the air flow passageway, at the forward discharge opening of the air flow passageway, or forwardly of the air flow passageway, (iii) the surrounding exterior surface has a maximum lateral outside diameter or width at a location which is rearward of the forward longitudinal end the flow momentum enhancing device, and (iv) the surrounding exterior surface has an outside diameter or width at the forward longitudinal end of the flow momentum enhancing device which is less than the maximum lateral outside diameter or width such that, as the surrounding exterior surface extends forwardly from the location of the maximum lateral outside diameter or width, at least a forward longitudinal portion of the surrounding exterior surface converges inwardly, preferably but not necessarily in a straight or curving manner, with respect to the longitudinal axis of the flow momentum enhancing device as the surrounding exterior surface approaches the forward longitudinal end of the flow momentum enhancing device.

In step (b), the flow stream is caused to flow over and in contact with the maximum lateral outside diameter or width of the surrounding exterior surface and then along and in contact with the inwardly converging forward longitudinal portion of the surrounding exterior surface to create a reduced pressure region around at least a portion of the surrounding exterior surface and/or at the forward longitudinal end of the flow momentum enhancing device which draws inert products of combustion into the reduced pressure region.

Further aspects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Before explaining the present invention in detail, it is important to understand that the invention is not limited in its application to the details of the preferred embodiments and steps described herein. The invention is capable of other embodiments and of being practiced or carried out in a variety of ways. It is to be understood that the phraseology and terminology employed herein is for the purpose of description and not of limitation.

Also, unless otherwise specified, the inventive features, structures, and steps discussed herein can be advantageously employed using any number or type of fuel ejection tips. In addition, the inventive burners described herein (a) can be single stage burners or burners using staged fuel and/or staged air designs and (b) can be oriented upwardly, downwardly, horizontally, or at generally any other desired operating angle.

Figure 1:
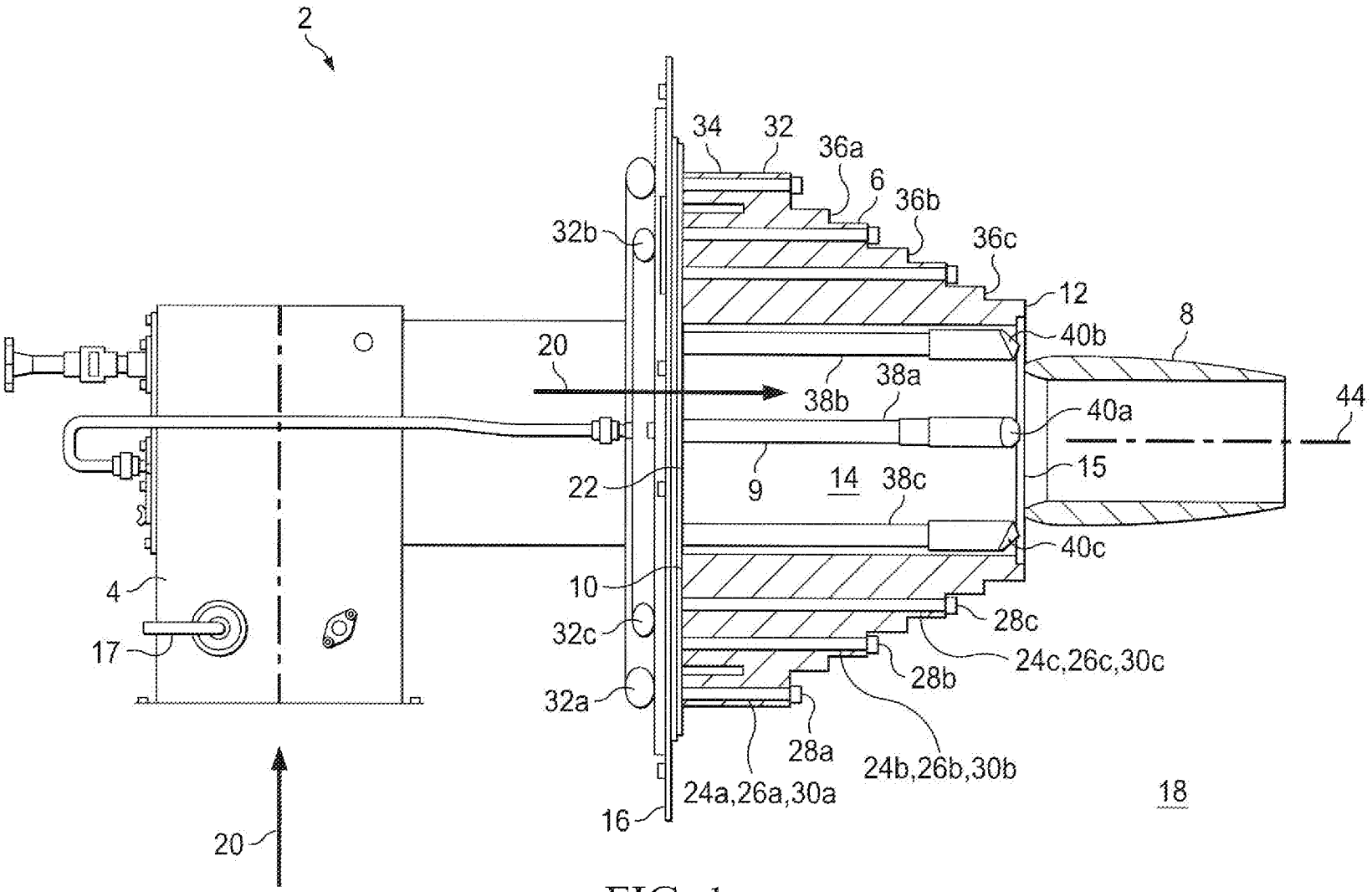
FIG. 1 is a partially cutaway elevational side view of an embodiment 2 of the burner apparatus provided by the present invention.
Figure 2:
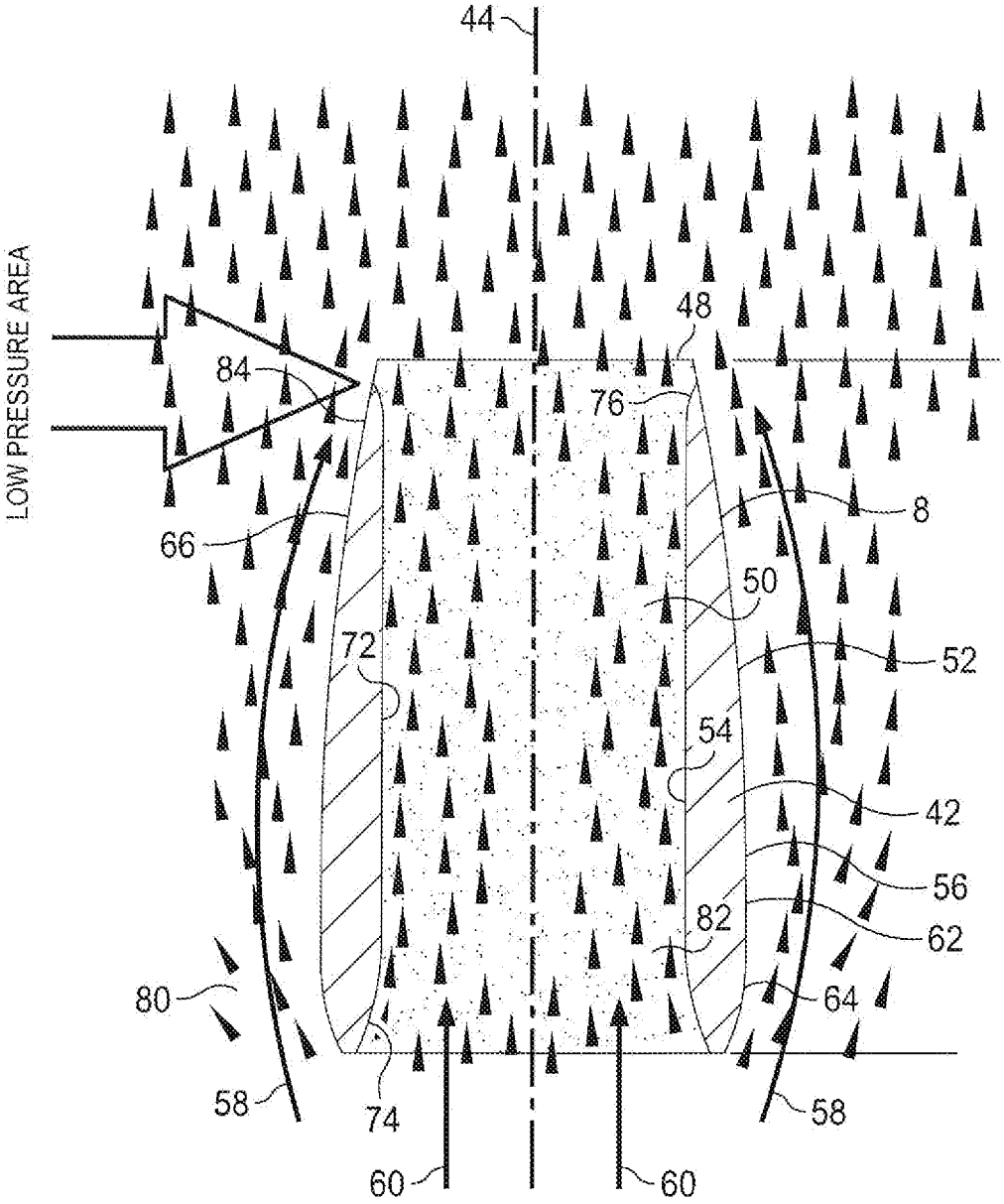
FIG. 2 is a schematic flow diagram for an embodiment 8 of the flow momentum enhancing device provided by the present invention.
Figure 3:
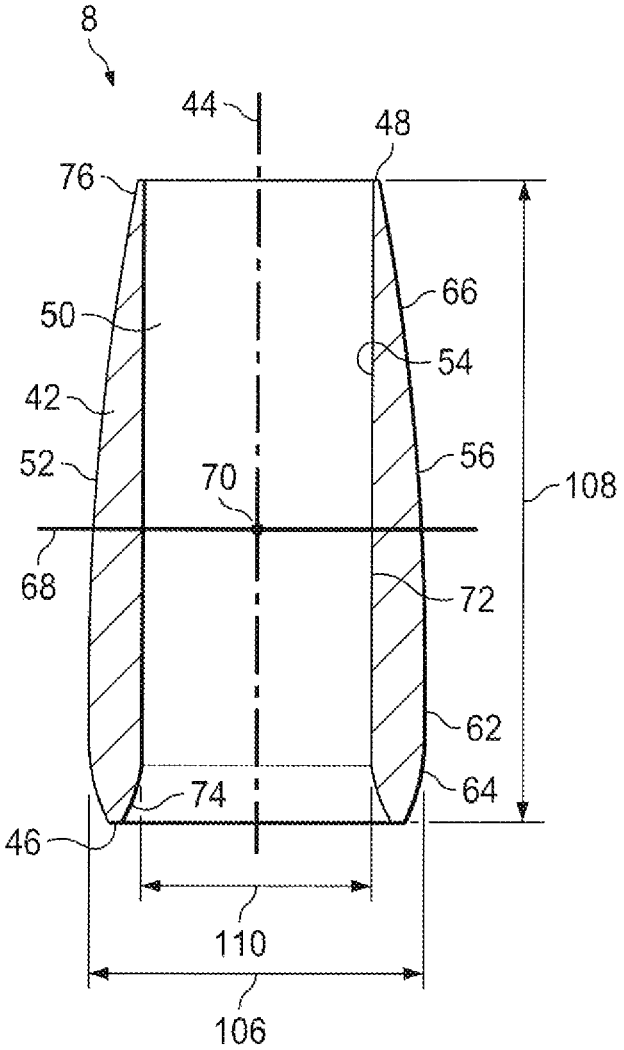
FIG. 3 is a cutaway elevational view of the inventive flow momentum enhancing device 8.

A first embodiment 2 of the burner apparatus provided by the present invention is illustrated in FIGS. 1-3. The inventive burner 2 comprises a housing 4, a burner wall 6, and an inventive flow momentum enhancing device 8. The burner wall 6 has: a longitudinal axis 9; a rearward longitudinal end 10; a forward longitudinal end 12; and a combustion air passageway or throat 14 which extends longitudinally through the burner wall 6. The combustion air passageway 14 has a forward discharge opening 15 at the forward longitudinal end 12 of the burner wall 6. The inventive flow momentum enhancing device 8 can be positioned in, partially in, at the forward end of, or forwardly of the combustion air passageway 14.

The inventive burner 2 is shown as installed through the wall 16 of a combustion chamber 18. The inventive burner apparatus 2 can be used to heat the combustion chamber 18 of generally any type of fired heating system. The combustion chamber 18 is filled with the gaseous inert products of combustion (i.e., flue gas) produced in the combustion chamber 18 by the burner combustion process.

A combustion air stream 20 is received in the housing 4 of the inventive burner 2 and is directed into the rearward longitudinal end 22 of burner throat 14. The quantity of combustion air entering housing 12 is regulated by an air inlet damper 17. The combustion air stream 20 can be provided to housing 12 as necessary by forced circulation, natural draft, a combination thereof, or in any other manner employed in the art. The combustion air stream 20 will preferably be delivered to the inventive burner assembly 2 by forced draft.

As used herein and in the claims, unless otherwise stated, it will be understood that the combustion air stream 20 which travels through the air flow passageway 14 can be 100% air or can be a mixture of combustion air with one or more other components such as, but not limited to, fuel gas, externally recirculated flue gas, steam, $CO_2$, and/or $N_2$. Also, it will be understood with respect to all of the embodiments and configurations disclosed herein that the inventive burner is not limited only to the use of air as the oxygen source for combustion.

The burner wall 6 is preferably constructed of a high temperature refractory burner tile material. However, it will be understood that the burner wall 6 of the inventive burner 2 can alternatively be formed of, or provided by, the furnace floor, a metal band, a refractory band, or any other material or structure which is capable of (a) providing an acceptable combustion air flow passageway 14 into the combustion chamber 18 of fired heating system and (b) withstanding the high temperature operating conditions therein.

The air flow passageway/throat 14 of the inventive burner 2 is preferably surrounded by one, two, three, or more series 24*a*, 24*b*, 24*c* of outer ejection tips, nozzles, or other fuel ejectors 26*a*, 26*b*, or 26*c* which eject a gas fuel, a liquid fuel, or a combination thereof outside of the burner wall for combustion in a primary combustion zone, which begins substantially at or forwardly of the forward longitudinal end 12 of the burner wall 6, and also optionally in one or more subsequent secondary combustion zones. In the inventive burner 2, each ejector 26*a*, 26*b*, or 26*c* is depicted as comprising a fuel ejection tip 28*a*, 28*b*, or 28*c* which is secured on the end of a riser or other fuel conduit 30*a*, 30*b*, or 30*c* which is in communication with a fuel supply manifold 32*a*, 32*b*, or 32*c*. Each fuel riser 30*a*, 30*b*, and 36*c* extends through the wall 16 of the combustion chamber 18 and then longitudinally through a surrounding outer skirt portion 32 of the burner wall 6. Alternatively, rather than extending through the outer skirt 32 of the burner wall 6, one or more series 24*a*, 24*b*, and/or 24*c* of the fuel tip risers 30*a*, 30*b*, or 30*c* can extend into the combustion chamber 18 around, and outside of, the burner wall structure.

In the inventive burner apparatus 2 as illustrated in FIG. 1, the series 24*a* of fuel ejectors 26*a* which surround and are closest to the air flow throat 14 preferably eject a gas or liquid fuel, preferably a gas fuel, for combustion in a primary combustion zone which begins at or near the forward end 12 of the burner wall 6. The second series 24*b* of fuel ejectors 26*b* which surround the first series 24*a*, and the third series 24*c* of fuel ejectors 26*c* which surround the second series 24*b*, preferably eject a gas or liquid fuel, more preferably a gas fuel, for combustion in one or two secondary combustion zones which follow the primary combustion zone.

As the fuel streams discharged from the fuel ejectors 26*a*, 26*b*, and 26*c* flow outside of the burner wall 6, flue gas from the furnace enclosure 18 is entrained in the ejected fuel streams and is mixed therewith.

In addition, the burner wall structure 6 employed in inventive burner 2 preferably has a tiered exterior shape wherein the diameter of the base 34 of the surrounding outer skirt 32 of the burner wall structure 6 is broader than the forward longitudinal end 12 and wherein, beginning at the base 34 and proceeding forward, the exterior of the burner wall structure 6 presents a converging series of spaced apart impact edges 36*a*, 36*b*, and 36*c* of decreasing diameter. The outer impact edges 36*a*, 36*b*, and 36*c* provide enhanced mixing of the internal flue gas with the ejected fuel streams.

The inventive burner apparatus 2 also includes one or more burner pilots 38*a*, 38*b*, 38*c* for initiating and maintaining combustion at the outer end 12 of the burner 2. Each pilot 38*a*, 38*b*, and/or 38*c* extends through the burner throat 14 and has a pilot combustion tip 40*a*, 40*b*, or 40*c* at the distal end thereof which is preferably positioned at or near the forward longitudinal end 12 of the burner wall 6.

The lateral cross-sectional shape of the burner wall 6 of inventive burner 2 can be circular, square, rectangular, oval or generally any other desired shape. In addition, the one or more series 24*a*, 24*b*, 24*c* of fuel ejectors 26*a*, 26*b*, 26*c* employed in the inventive burner 2 need not entirely surround the burner wall 6. For example, the ejectors 26*a*, 26*b*, or 26*c* may not completely surround the burner wall 6 in certain applications where the inventive burner 2 is used in a furnace sidewall location or must be specially configured to provide a particular desired flame shape.

The lateral cross-sectional shape of the flow momentum enhancing device 8 provided by and used in the present invention will preferably correspond to the lateral cross-sectional shape of the burner wall 6 so that, for example (a) if the burner wall 6 is circular then the lateral cross-sectional shape of the inventive device 8 will preferably also be circular, (b) if the burner wall 6 is rectangular then the lateral cross-sectional shape of the inventive device 8 will preferably also be rectangular, (c) etc.

As illustrated in FIGS. 1-3, the inventive flow momentum enhancing device 8 used in the burner apparatus 2 comprises a momentum enhancing body 42 having: a longitudinal axis 44; a rearward longitudinal end 46; a forward longitudinal end 48; a longitudinal interior passageway 50 which extends through the device body 42 from the rearward longitudinal end 46 to the forward longitudinal end 48; a wall 52 of the device body 42 which surrounds the interior passageway 50; an interior surface 54 of the device wall 52, for the interior passageway 50, which extends from the rearward longitudinal end 46 to the forward longitudinal end 48; a surrounding exterior surface 56 of the device wall 52 which extends from the rearward longitudinal end 46 to the forward longitudinal end 48; an exterior flow path 58, for all or a first portion of the combustion air stream 20 which travels through the air flow passageway 14 of the burner wall 6; and an interior flow path 60, for all or a second portion of the combustion air stream 20. The exterior flow path 58 runs along and in contact with the exterior surface 56 of the flow momentum enhancing device 8 from the rearward longitudinal end 46 to the forward longitudinal end 48. The interior flow path 60 runs through the interior passageway 50 of the flow momentum enhancing device 8 from the rearward longitudinal end 46 to the forward longitudinal end 48.

As seen in the longitudinal cross-sectional views of the flow momentum enhancing device 8 provided in FIGS. 1-3, the longitudinal cross-sectional shape of the wall 52 of the device 8 is preferably a non-symmetrical wing airfoil shape wherein the rearward longitudinal end 46 of the device wall 52 is rounded and the exterior surface 56 of the device wall 52 is a longitudinally curved surface which comprises: a maximum lateral outside diameter or width at a location 62 which is rearward of the forward longitudinal end 48 the flow momentum enhancing device 2; an outside diameter or width at the forward longitudinal end 48 of the enhancing device 8 which is less than the maximum lateral outside diameter or width 62; an initial longitudinal segment 64 of the exterior surface 56 which curves outwardly, with respect to the longitudinal axis 44 of the device 2, as the exterior surface 56 extends from the rearward longitudinal end 46 to the location 62 of the maximum lateral outside diameter or width; and a forward longitudinal segment 66 of the exterior surface 56 which curves inwardly, with respect to the longitudinal axis 44, as the exterior surface 56 extends from the location 62 of the maximum lateral outside diameter or width to the forward longitudinal end 48 of the flow enhancing device 8.

Consequently, in this embodiment, the longitudinal location 62 of the maximum lateral outside diameter or width of the exterior surface 56 of the flow momentum enhancing device 8 is located forwardly of the rearward longitudinal end 46 of the enhancing device 8. In addition, the longitudinal location 62 of the maximum lateral outside diameter or width of the exterior surface 56 of the flow momentum enhancing device 8 is preferably located at or rearwardly of a lateral plane 68 which (a) is perpendicular to the longitudinal axis 44 and (b) extends through the longitudinal center point 70 of the flow momentum enhancing device 8 (i.e., the point 70 which is half way between the longitudinal rearward and forward ends 46 and 48 of the enhancing device 8). The longitudinal location 62 of the maximum lateral outside diameter or width of the exterior surface 56 of the flow momentum enhancing device 8 is more preferably located rearwardly of the lateral center plane 68.

The interior surface 54 surrounding the longitudinal interior passageway 50 of the flow momentum enhancing device 8 preferably comprises a straight longitudinal segment 72 which (a) is spaced forwardly of the rearward longitudinal end 46 of the enhancing device 8, (b) is parallel to the longitudinal axis 44 of the enhancing device 8, and (c) has an internal diameter or width which is preferably less that the internal diameter or width of the interior passageway 50 at the rearward longitudinal end 46 of the enhancing device 8. The interior surface 54 surrounding the longitudinal interior passageway 50 preferably also comprises an initial segment 74 which curves inwardly, with respect to the longitudinal axis 44, from the rearward longitudinal end 46 of the enhancing device 8 to the straight longitudinal segment 72. In addition, the interior surface 54 surrounding the longitudinal interior passageway 50 can also include a beveled or curved forward edge or segment 76 which angles or curves outwardly, with respect to the longitudinal axis 44, from the forward end of the straight longitudinal segment 72 to the forward longitudinal end 48 of the flow momentum enhancing device 8.

By way of example, but not by way of limitation, it will be understood that, as alternatives to the substantially "flat bottomed" non-symmetrical wing airfoil shape of the flow momentum enhancing device 8 illustrated in FIGS. 1-3, the longitudinal cross-sectional shape of the surrounding wall 52 of the enhancing device 8 can be (a) a symmetrical wing shape, (b) a non-symmetrical, non-flat bottomed, wing shape having different camber widths for the outer and inner surfaces, or (c) other airfoil shapes.

In accordance with the method of the present invention, when the combustion air stream 20 traveling through the air flow passageway 14 of the burner wall 6 reaches the rearward longitudinal end 46 of the flow momentum enhancing device 8, the inventive enhancing device 8 divides the combustion air stream 20 into (a) a first (exterior) portion 80 of the stream 20 which flows longitudinally along the exterior flow path 58 in contact with the exterior surface 56 of the enhancing device 8 and (b) a second (interior) portion 82 of the stream 20 which flows longitudinally through the interior passageway 50 of the enhancing device 8 along the interior flow path 60.

As the exterior stream 80 flows along the exterior flow path 58, the exterior stream 80 must travel (a) along and in contact with the initial, outwardly curved longitudinal segment 64 of the exterior surface 56, then (b) over and in contact with the location 62 of the maximum lateral outside diameter or width of the exterior surface 56, and then (c) along and in contact with the inwardly curving forward longitudinal segment 66 of the exterior surface 56. Consequently, similar to the production of "lift" by an aircraft wing, the distance which the exterior stream 80 must travel to reach the forward end 48 of the flow momentum enhancing device 8 is greater than the distance traveled by the interior stream 82, thus increasing the relative velocity of the exterior stream 80 and creating a reduced pressure region 84 on and adjacent to the exterior surface 56 of the enhancing device 8 and/or at the forward longitudinal end 48 thereof. The reduced pressure region 84 draws inert products of combustion (flue gas) from the interior of the combustion chamber 18 surrounding the burner wall 6 to mix with the combustion air stream 20 and with any fuel which is delivered to the reduced pressure region 84 by the fuel ejectors 26*a*, 26*b*, and/or 26*c*.

In FIG. 1, the inventive burner apparatus 2 is shown with the flow momentum enhancing device 8 being positioned such that (a) the rearward longitudinal end 46 of the enhancing device 8 is located at the forward longitudinal end 12 of the burner wall 6 and (b) the flow momentum enhancing device 8 is centered with respect to the forward discharge opening 15 of the air flow passageway 14 of the burner wall 6. Consequently, in this configuration, the longitudinal axis 44 of the flow momentum enhancing device 8 is coaxial with the longitudinal axis 9 of the burner wall 6.

Figure 4:
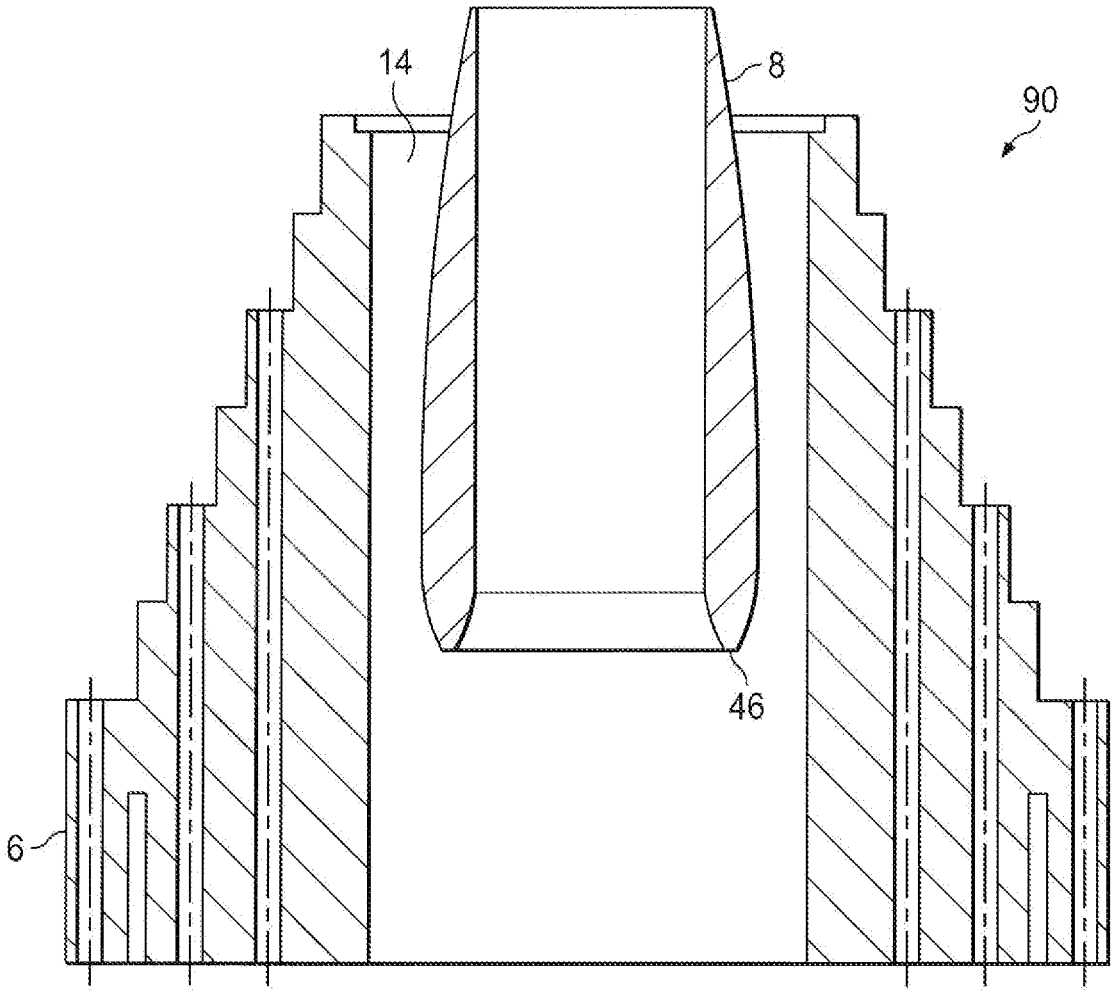
FIG. 4 is a schematic cutaway elevational view of an alternative configuration 90 of the inventive burner apparatus.

In FIG. 4, an alternative configuration 90 of the inventive burner apparatus 2 is schematically illustrated wherein the rearward longitudinal end 46 of the inventive flow momentum enhancing device 8 is positioned in the air flow passageway 14 of the burner wall 6.

Figure 5:
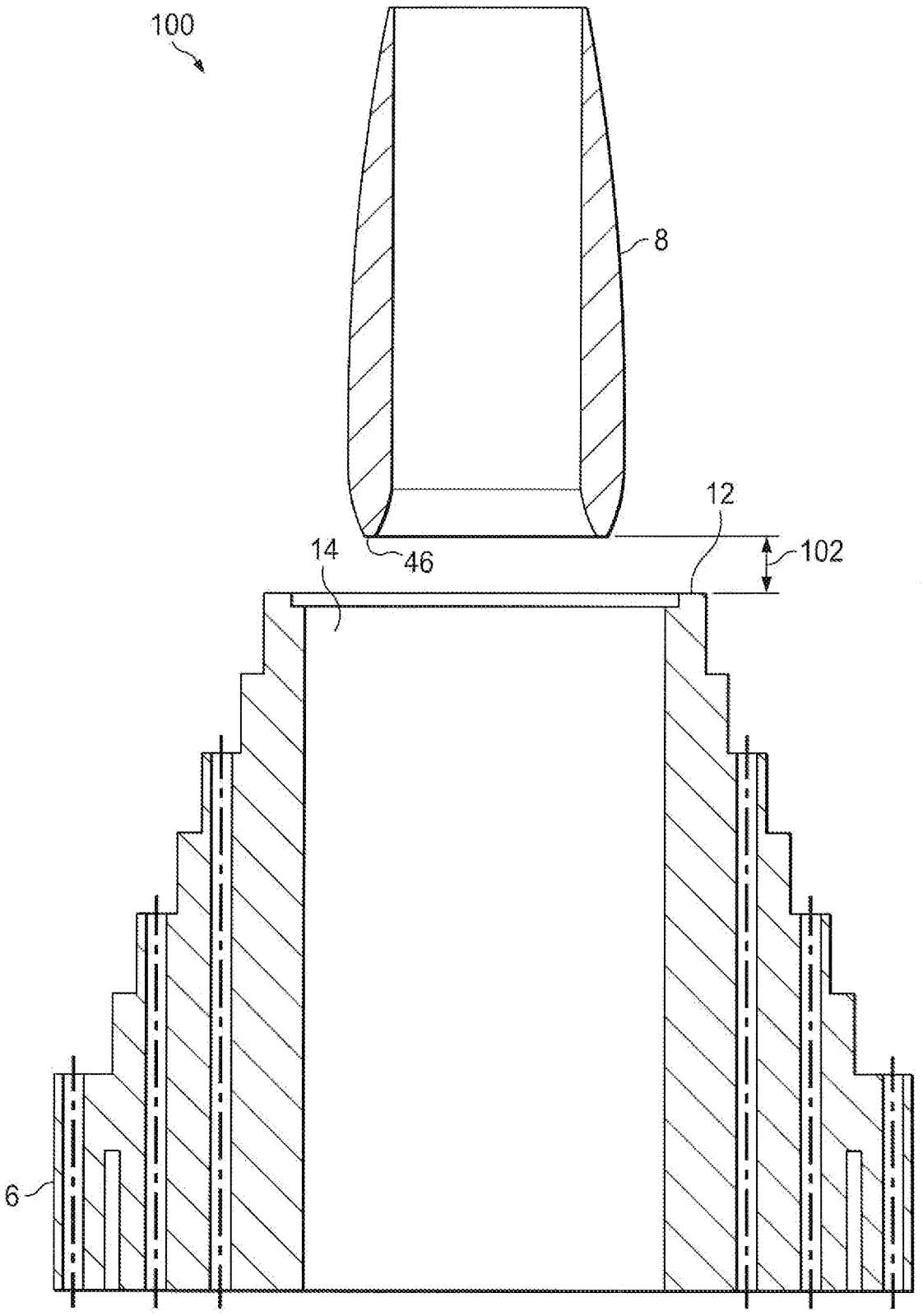
FIG. 5 is a schematic cutaway elevational view of an alternative configuration 100 of the inventive burner apparatus.

In FIG. 5, a more preferred alternative configuration 100 is schematically illustrated in which the rearward longitudinal end 46 of the inventive flow momentum enhancing device 8 is space a distance 102 forwardly of forward longitudinal end 12 of the burner wall 6. The distance 102 will preferably be in the range of from 0.25 to 6 inches and will more preferably be in the range of from 0.5 to 4 inches.

Figure 6:
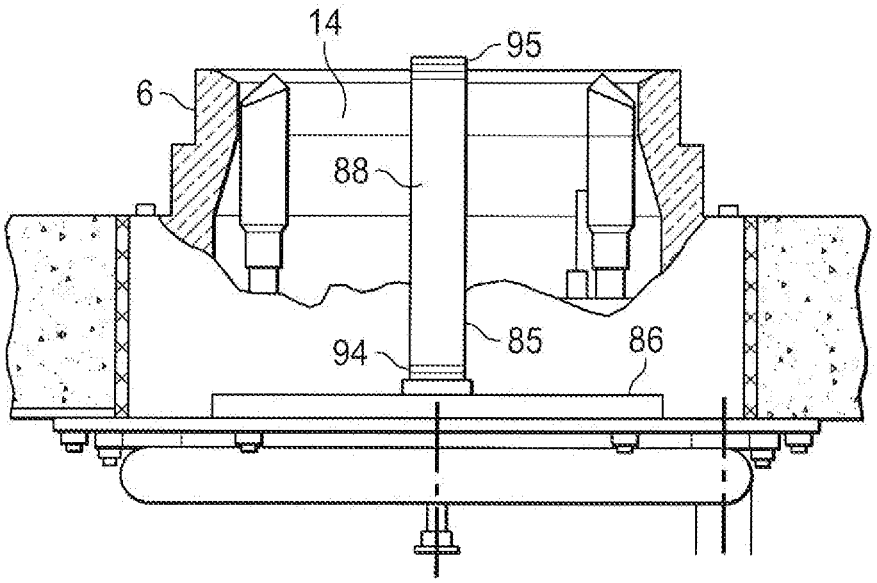
FIG. 6 is a cutaway side view showing a base 86 and a holding element 88 of a mounting assemble 85 for the inventive flow momentum enhancing device 8 installed in the inventive burner apparatus.
Figure 7:
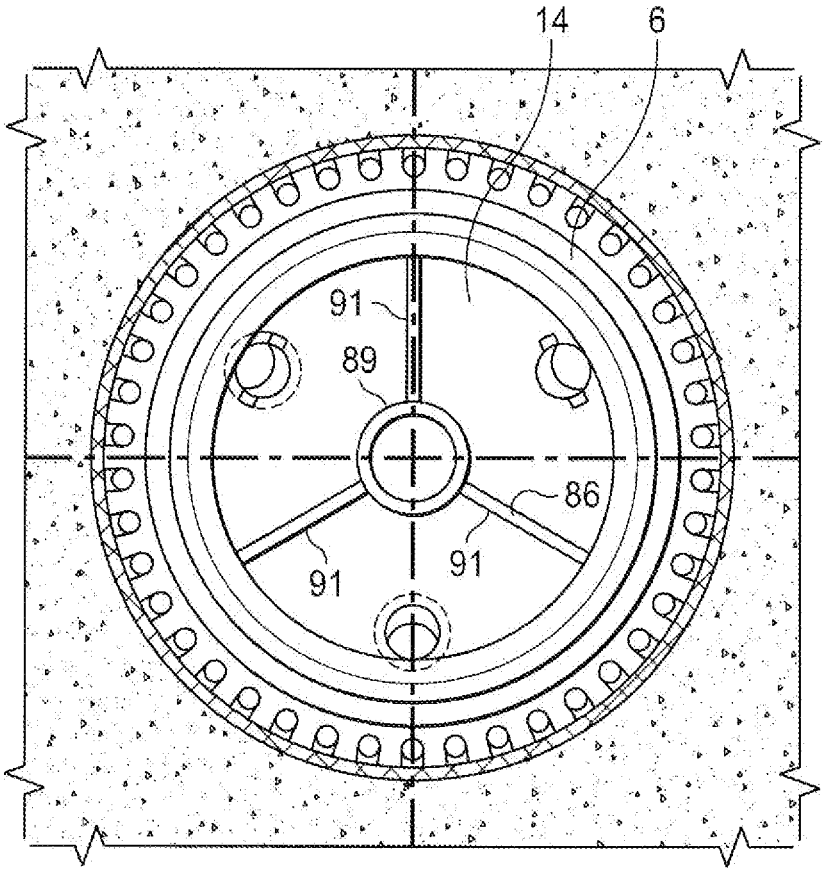
FIG. 7 is a cutaway top view showing the base 86 of the mounting assemble 85 installed in the inventive burner apparatus.
Figure 8:
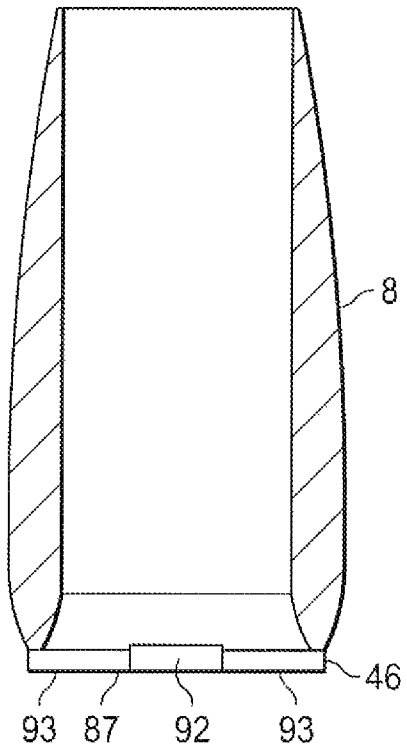
FIG. 8 is a cutaway elevational view showing an outer connecting element 87 of the mounting assembly 85 installed on the rearward longitudinal end of the inventive flow momentum enhancing device 8.

An example of a mounting assembly 85 for the inventive flow momentum enhancement device 8 is shown in FIGS. 6-8. The mounting assembly 85 comprises: a base 86; an outer connecting element 87; and a holding element 88 which extends from the base 86 to the outer connecting element 87. The base 86 comprises a connecting ring 89 having a plurality of (preferably three) support arms 91 which extend outwardly from the support ring 89 and have outer ends which are secured in, beneath or rearwardly of the burner wall 6. Similarly, the outer connecting element 87 comprises a connecting ring 92 and a plurality of (preferably three) support arms 93 which extend outwardly from the connecting ring 92 and have outer ends which are secured in or to the rearward longitudinal end 46 of the flow momentum enhancing device 8. The holding element 88 is preferably a rod or a segment of pipe or tubing having (a) a rearward end 94 which is threadedly or otherwise connected to the base connecting ring 89 and (b) a forward end 95 which is threadedly or otherwise connected to the connecting ring 92 of the connecting element 87.

For each of the configurations of the inventive burner apparatus 2 shown in FIGS. 1, 4, and 5, for a circular, square, rectangular, or oval burner wall 6, the inventive flow momentum enhancing device 8 will preferably be characterized in that: (a) the maximum lateral outside diameter or width 106 of the enhancing device 8 is from 1 to 5.5 inches less than the internal diameter or width of the forward discharge opening 15 of the air flow passageway 14; (b) the longitudinal length 108 of the enhancing device 8 is in the range of from 5 to 12 inches; and (c) the minimum internal diameter or width 110 of the enhancing device 8 is from 2.5 to 8 inches less than the maximum outside diameter or width 106 of the enhancing device 8.

Figure 9:
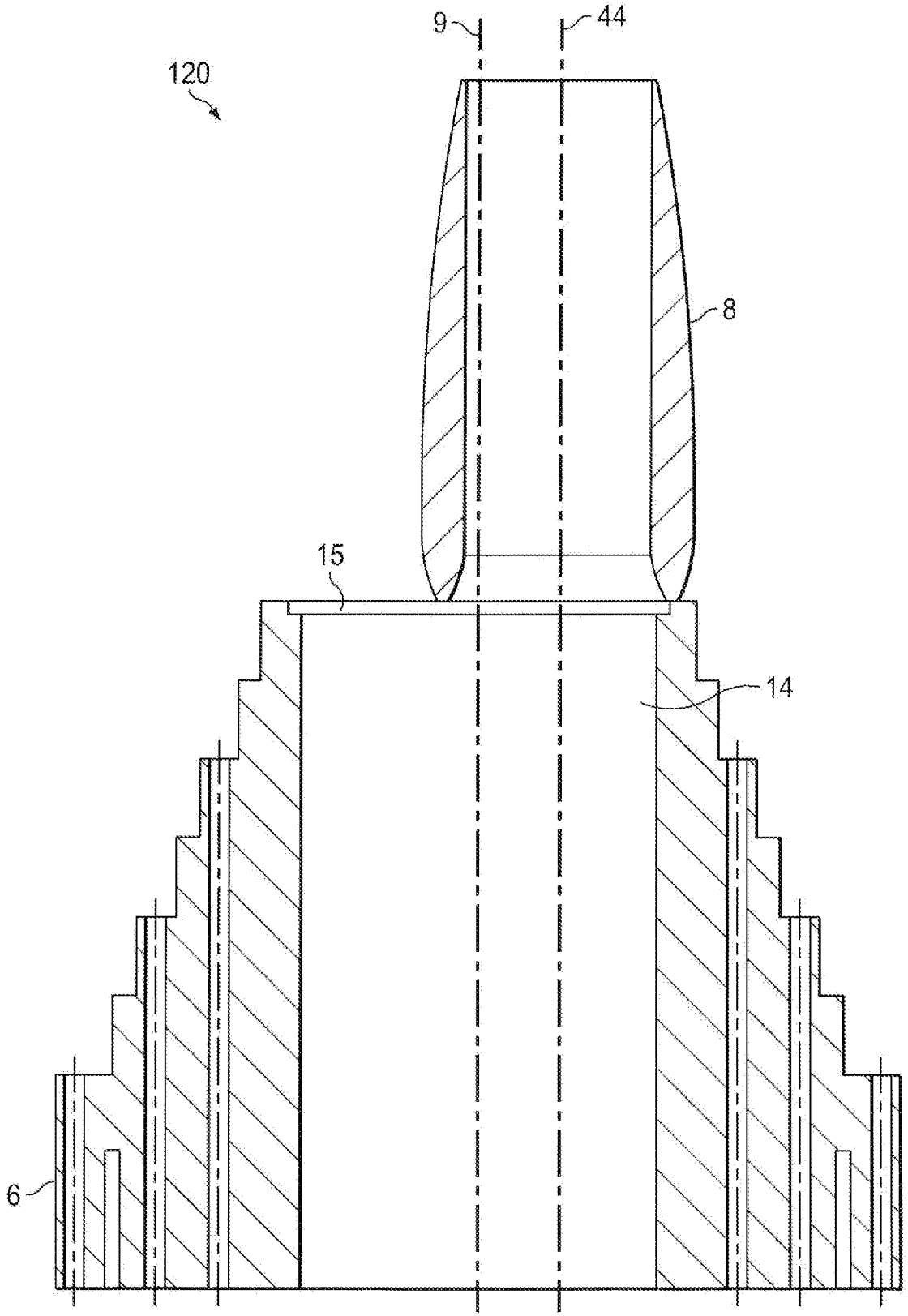
FIG. 9 is a schematic cutaway elevational view of an alternative configuration 120 of the inventive burner apparatus.

Another configuration 120 of the inventive burner apparatus 2 is schematically illustrated in FIG. 9. The configuration 120 shown in FIG. 9 is or can be identical to the configuration shown in any of FIGS. 1, 4, and 5, except that in the configuration 120, the flow momentum enhancing device 8 is not centered with respect to the forward discharge opening 15 of the air flow passageway 14. Rather, in the configuration 120, the enhancing device 8 is positioned such that longitudinal axis 44 of the flow momentum enhancing device 8 is offset with respect to the longitudinal axis 9 of the air flow passageway 14. The offset positioning of the flow momentum enhancing device 8 as illustrated in the configuration 120 of FIG. 9 can be used, for example, if a single offset fuel jet is positioned in the air flow passageway 14 of the burner wall 6 in addition to or in replacement of some or all of the exterior fuel ejectors 26*a*, 26*b*, and/or 26*c*.

Figure 10:
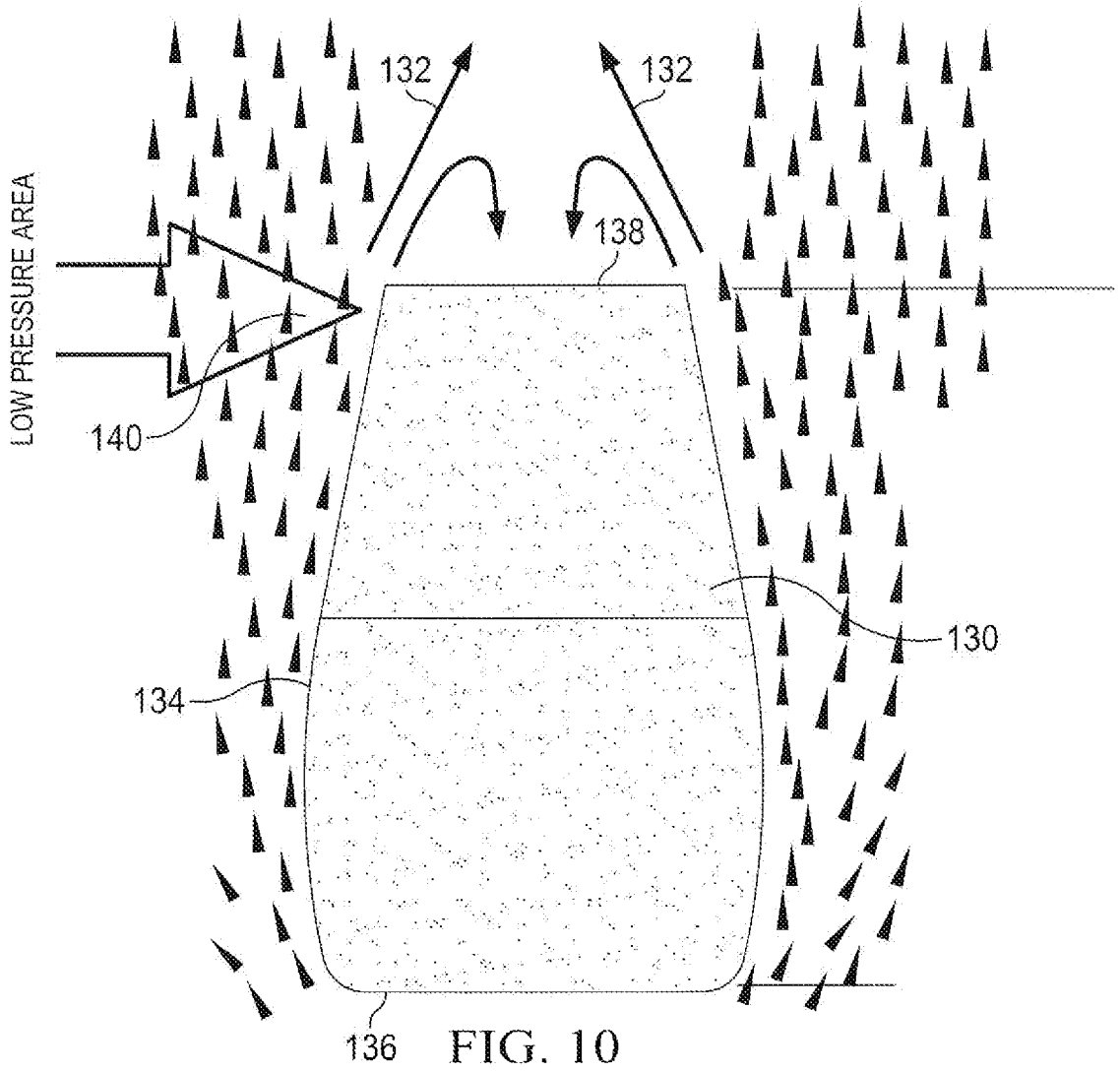
FIG. 10 is a cutaway elevational view of an alternative embodiment 130 of the flow momentum enhancing device provided by the present invention.

As another alternative for the inventive burner apparatus 20, the inventive flow momentum enhancing device 8 can be replaced with an alternative embodiment 130 of the enhancing device as illustrated in FIG. 10 which is identical to element 8 except that the flow enhancing device 130 has no interior passageway extending therethrough. Consequently, all of the combustion air stream 20 traveling through the air flow passageway 14 of the burner wall 6 flows outside of the enhancing device 130 in the longitudinal exterior flow path 132 which travels along and in contact with the exterior surface 134 from the rearward longitudinal end 136 to the forward longitudinal end 138 of the flow momentum enhancing device 130. As the combustion air stream is forced to travel along and in contact with the exterior surface 134, which has the same shape as the exterior of the enhancing device 8 discussed above, a reduced pressure region 140 is again created on and adjacent to the exterior surface 134 of the enhancing device 130 and/or at the forward longitudinal end 138 thereof. The reduced pressure region 140 draws inert products of combustion (flue gas) from the interior of the combustion chamber 40 surrounding the burner wall 6 to mix with the combustion air stream 20 and with any fuel which is delivered to the reduced pressure region 140 by the fuel ejectors 26*a*, 26*b*, and/or 26*c*.

Figure 11:
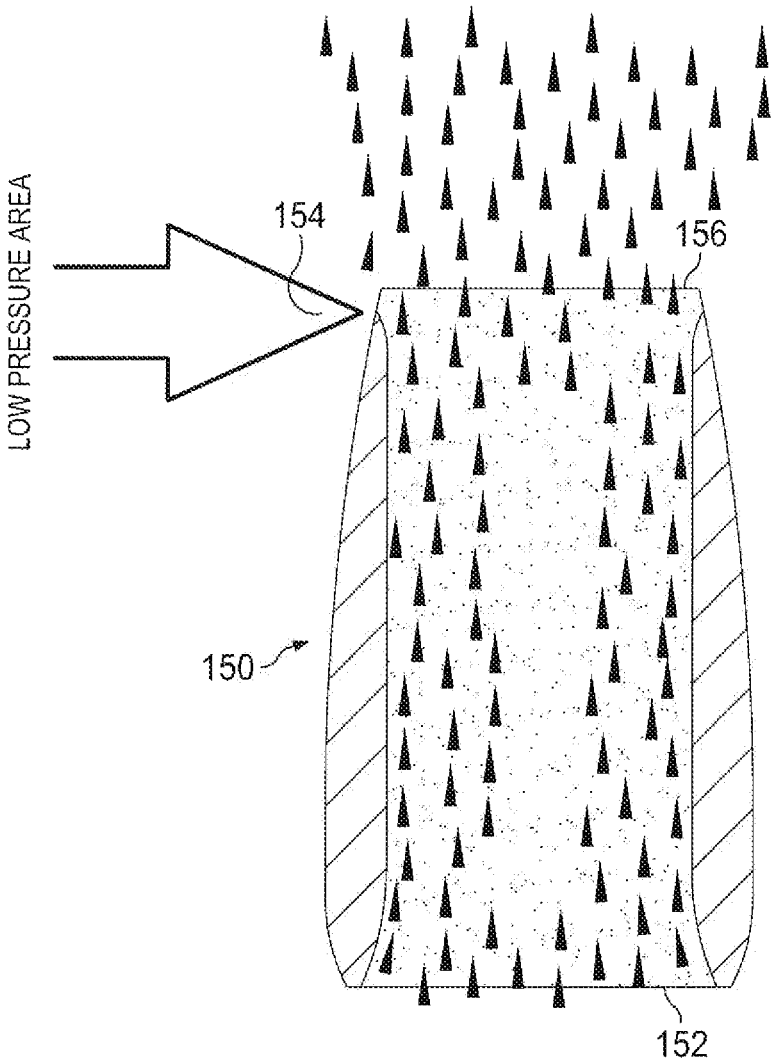
FIG. 11 is a cutaway elevational view of an alternative embodiment 150 of the flow momentum enhancing device provided by the present invention.

As another alternative for the burner apparatus 20, the inventive flow momentum enhancing device 8 can be replaced with an alternative embodiment 150 of the enhancing device which is identical to device 8 except that the flow enhancing device 150 is sized and positioned such that, as illustrated in FIG. 11, all of the combustion air stream 20 traveling through the air flow passageway 14 of the burner wall 6 must flow through the longitudinal interior passageway 152 extending through the inventive flow momentum enhancing device 150. This creates a reduced pressure region 154 at the forward longitudinal end 156 of the enhancing device 150 which draws inert products of combustion (flue gas) from the interior of the combustion chamber 18 surrounding the burner wall 6 to mix with the combustion air stream 20 and with any fuel which is delivered to the reduced pressure region 154 by the fuel ejectors 26*a*, 26*b*, and/or 26*c*.

Figure 12:
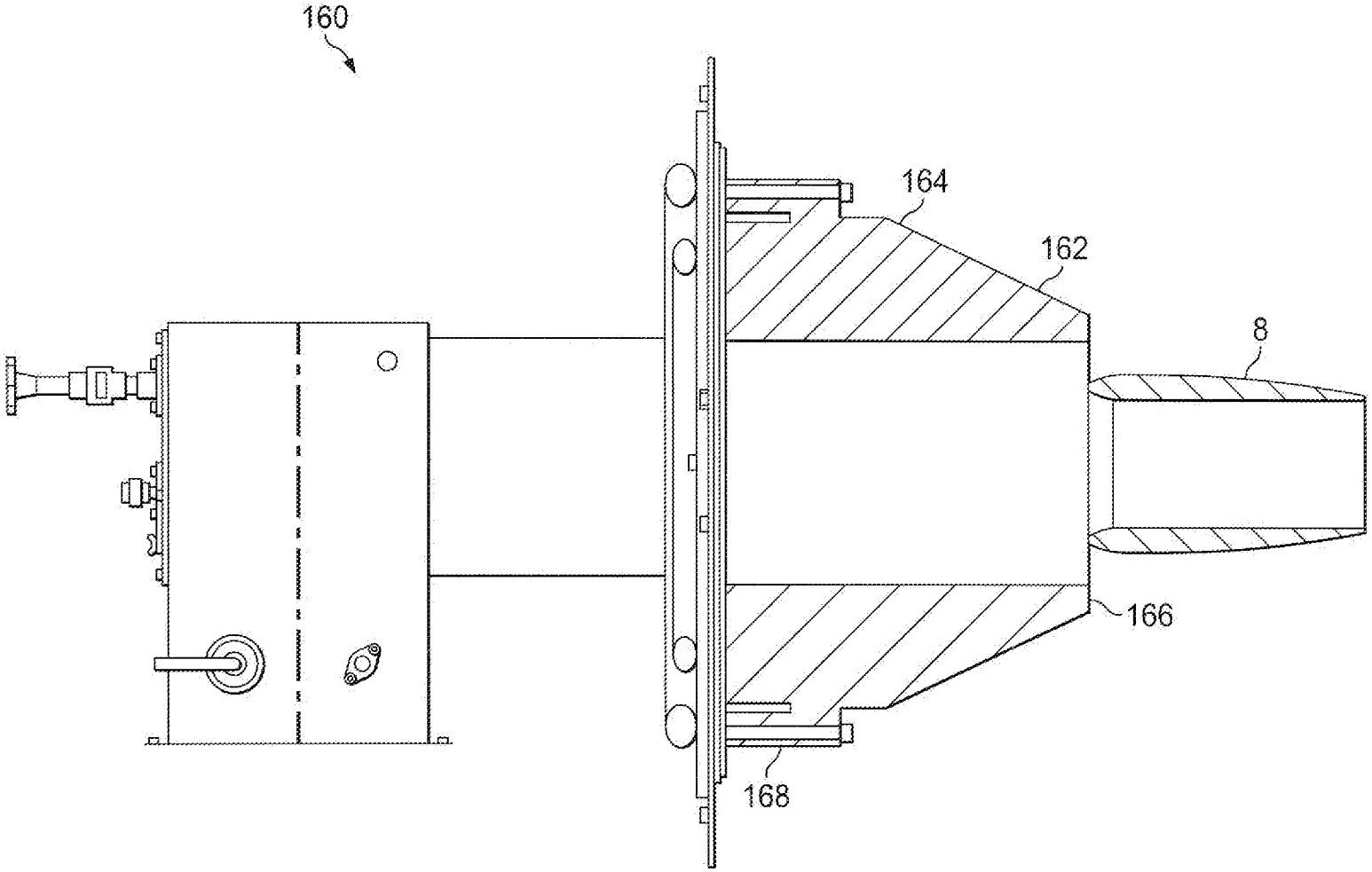
FIG. 12 is a partially cutaway elevational side view of an alternative embodiment 160 of the burner apparatus provided by the present invention.

Another alternative embodiment 160 of the inventive burner apparatus is illustrated in FIG. 12. The inventive burner apparatus 160 is identical to the burner apparatus 2 illustrated in FIG. 12, and can also be identical to any of the alternative configurations or embodiments of the inventive burner 2 illustrated in FIGS. 4, 5 and 9, except that (a) the forward portion 162 of the burner wall 164 of the burner 160 has a sloped exterior which converges inwardly toward the forward longitudinal end 166 of the burner wall 164 and (b) the burner apparatus 160 is illustrated as having only a single series of external fuel ejectors 168 which surround the burner wall 164.

Figure 13:
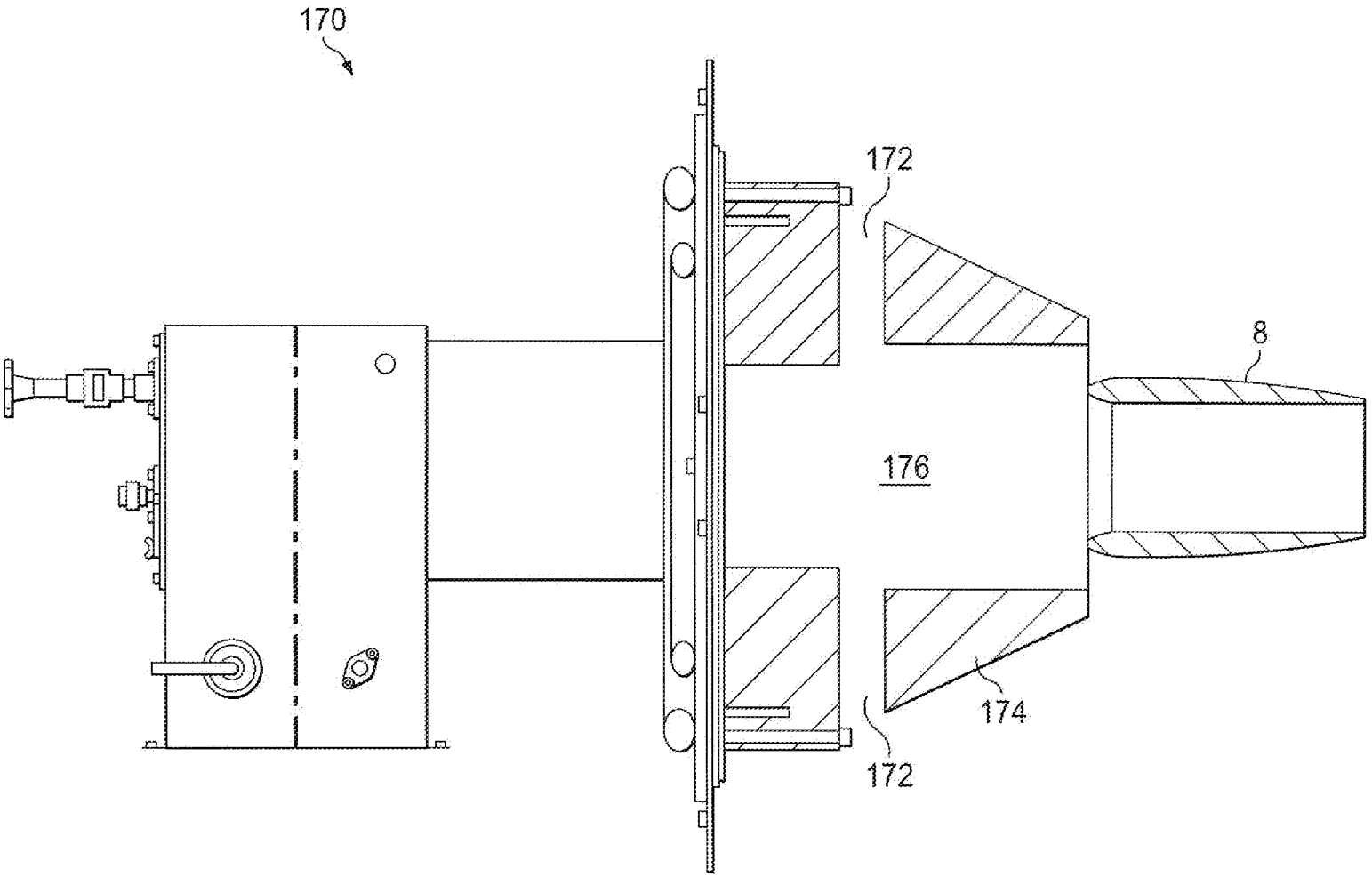
FIG. 13 is a partially cutaway elevational side view of an alternative embodiment 170 of the burner apparatus provided by the present invention.

Another alternative embodiment 170 of the inventive burner apparatus is illustrated in FIG. 13. The inventive burner apparatus 170 is identical to the inventive burner 160 except that, in the inventive burner 170, a plurality of lateral flue gas passageways 172 extend through the burner wall 174 to the combustion air passageway 176 of the burner wall 174 for aspirating internal products of combustion from the combustion chamber 40 into the combustion air stream flowing though the combustion air passageway 176.

Figure 14:
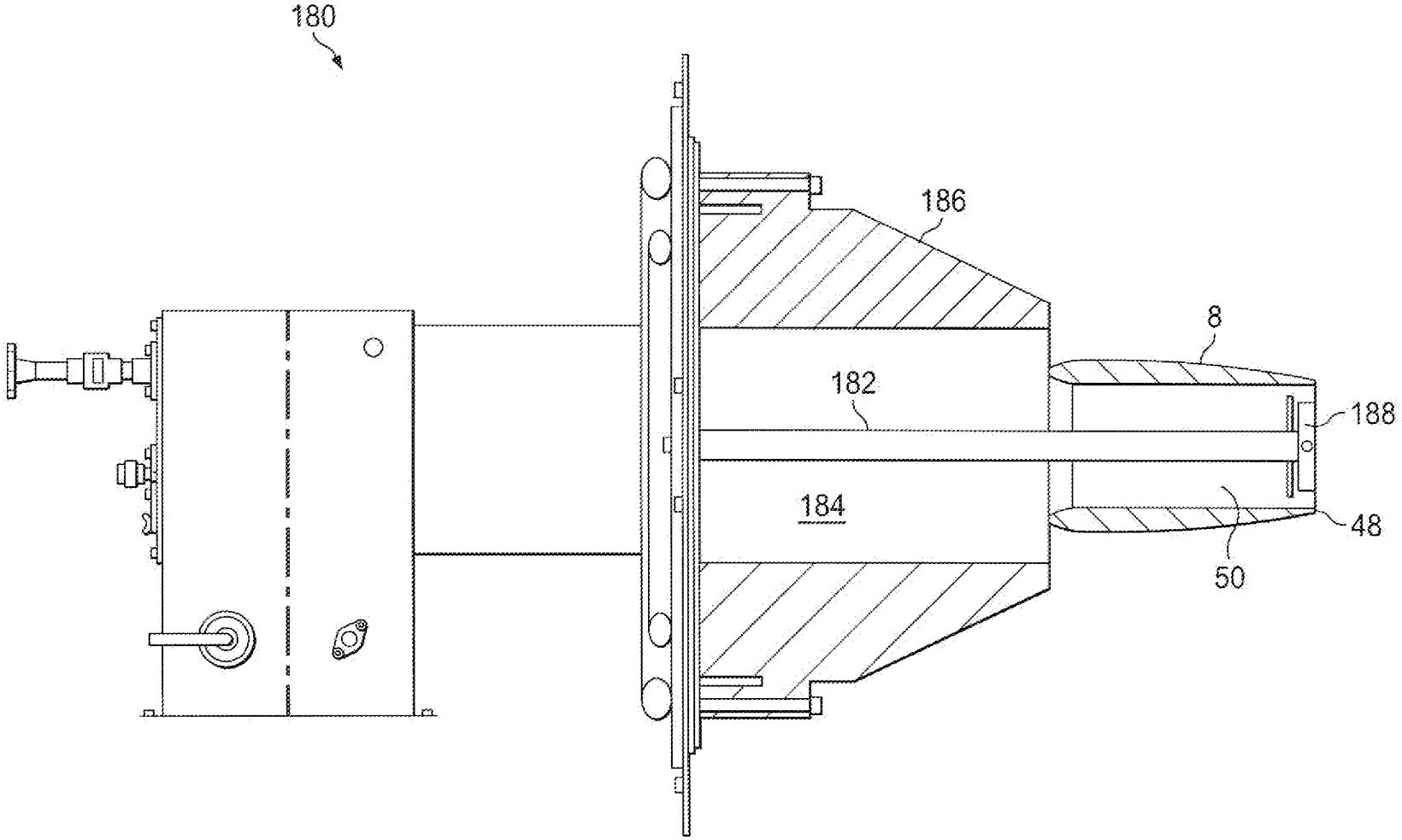
FIG. 14 is a partially cutaway elevational side view of an alternative embodiment 180 of the burner apparatus provided by the present invention.

Another alternative embodiment 180 of the inventive burner apparatus is illustrated in FIG. 14. The inventive burner apparatus 180 is identical to the inventive burner 160 except that the inventive burner apparatus 180 further comprises a fuel riser 182 which extends through the combustion air passageway 184 of the burner wall 186 to a primary fuel discharge tip 188. The primary fuel discharge tip 188 can be located in, at the forward longitudinal end 48 of, or forwardly of the interior passageway 50 of the inventive flow momentum enhancing device 8.

Figure 15:
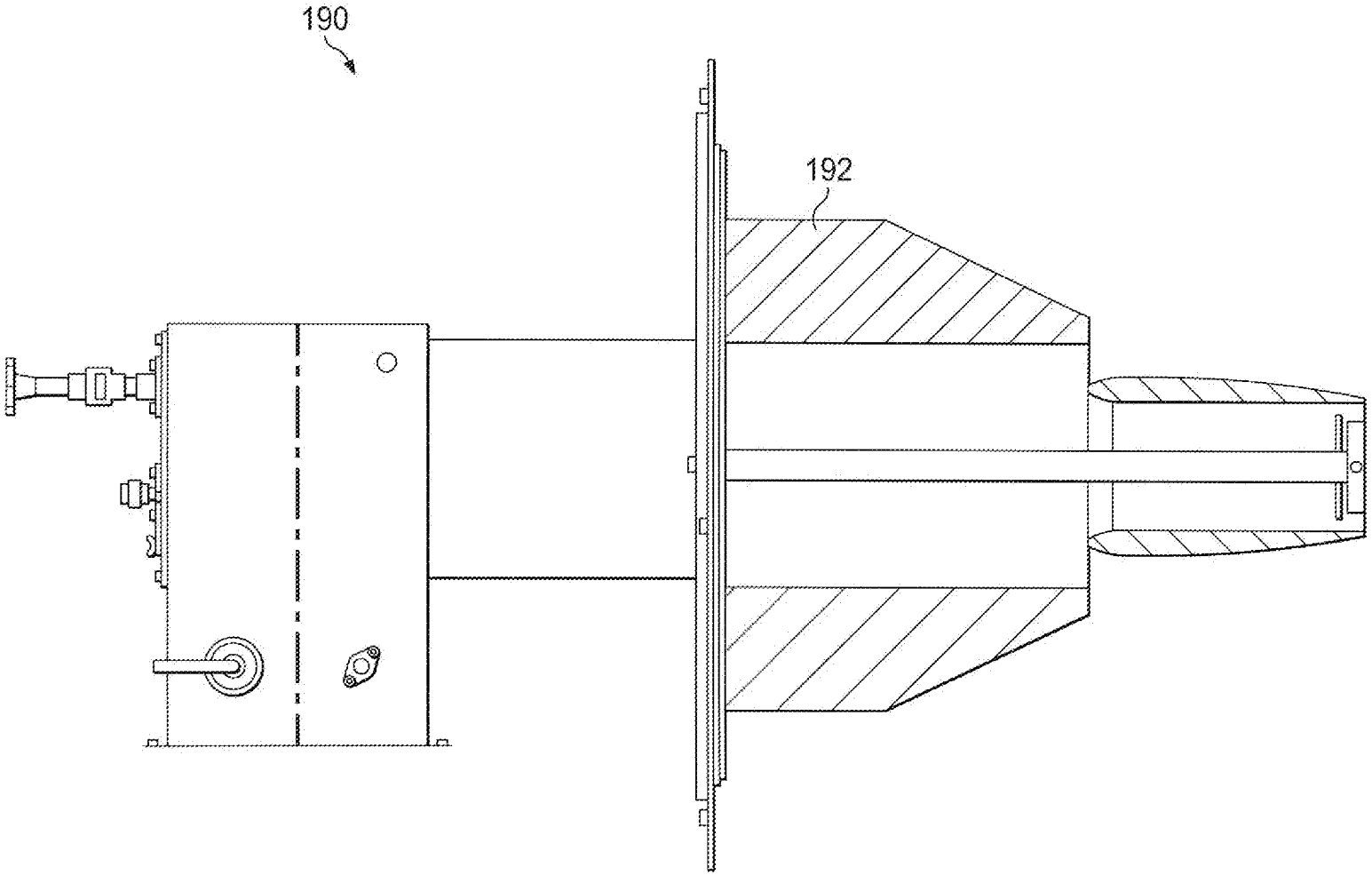
FIG. 15 is a partially cutaway elevational side view of an alternative embodiment 190 of the burner apparatus provided by the present invention.

Another alternative embodiment 190 of the inventive burner apparatus is illustrated in FIG. 15. The inventive burner apparatus 190 is identical to the inventive burner 180 except that inventive burner apparatus 180 has no external fuel ejectors outside of the burner wall 192.

Figure 16:
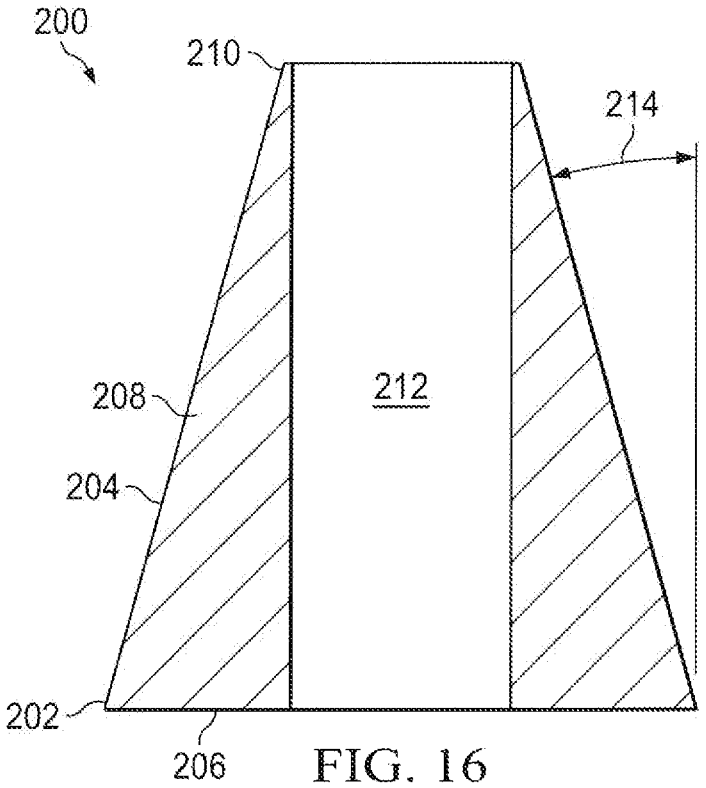
FIG. 16 is a cutaway elevational view of an alternative embodiment 200 of the flow momentum enhancing device provided by the present invention.

An alternative embodiment 200 of the inventive flow momentum enhancing device is illustrated in FIG. 16. The flow momentum enhancing device 200 can replace the flow momentum enhancing device 8 as used in any of the embodiments and configurations shown in FIGS. 1, 4, 5, 9, and 12-15. The flow momentum enhancing device 200 will operate in substantially the same way and will have the same preferred dimensions as the flow momentum enhancing device 8 except that: (a) the location 202 of maximum outer diameter or width of the exterior surface 204 of the enhancing device 200 is at the rearward longitudinal end 206 of the enhancing device 200; (b) the exterior surface 204 of the wall 208 of the device 200 has a conical or other straight converging shape (e.g., straight converging side walls for a square or rectangular burner) which extends from the rearward longitudinal end 206 to the forward longitudinal end 210 of the flow momentum enhancing device 200; and (c) the longitudinally extending interior passageway 212 of the enhancing device 200 preferably has a straight, constant, circular, square, rectangular, oval or other cross-sectional shape. The longitudinally extending interior passageway 212 preferably has a straight cylindrical shape. The angle of convergence 214 of the exterior surface 204 is preferably in the range of from 5° to 30°.

Figure 17:
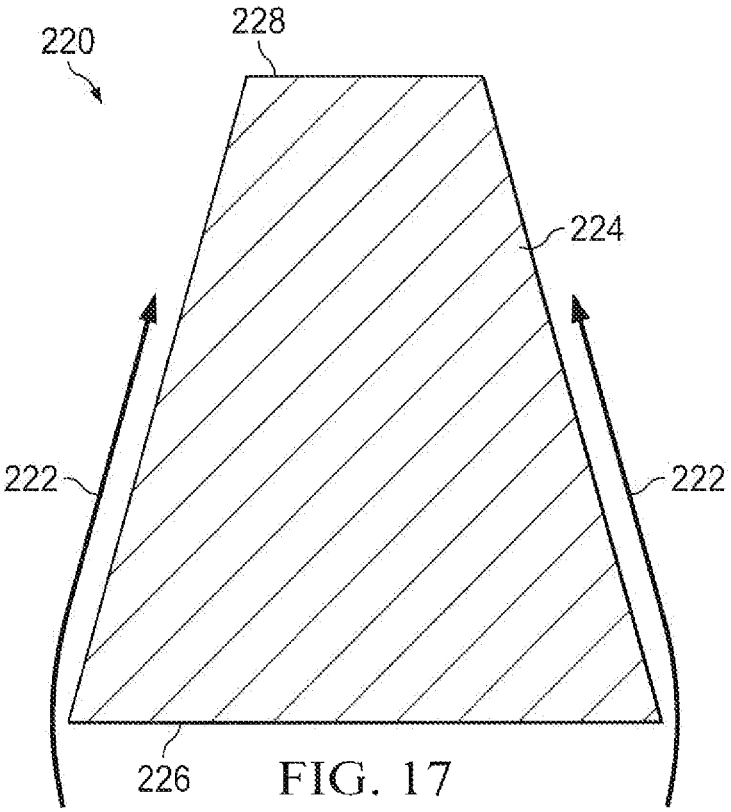
FIG. 17 is a cutaway elevational view of an alternative embodiment 220 of the flow momentum enhancing device provided by the present invention.

As another alternative for use in any of the embodiments and configurations of the inventive burner as illustrated in FIGS. 1, 4, 5, 9, and 12-15, the flow momentum enhancing devices 8, 130, and 200 can be replaced with an alternative embodiment 220 of the enhancing device which is illustrated in FIG. 17. The enhancing device 220 is identical to device 200 except that the flow momentum enhancing device 220 has no interior passageway extending therethrough. Consequently, all of the combustion air stream 20 traveling through the air flow passageway 14 of the burner wall 6 flows outside of the enhancing element 220 in the longitudinal exterior flow path 222 which travels along and in contact with the exterior surface 224 from the rearward longitudinal end 226 to the forward longitudinal end 228 of the flow momentum enhancing device 220.

Figure 18:
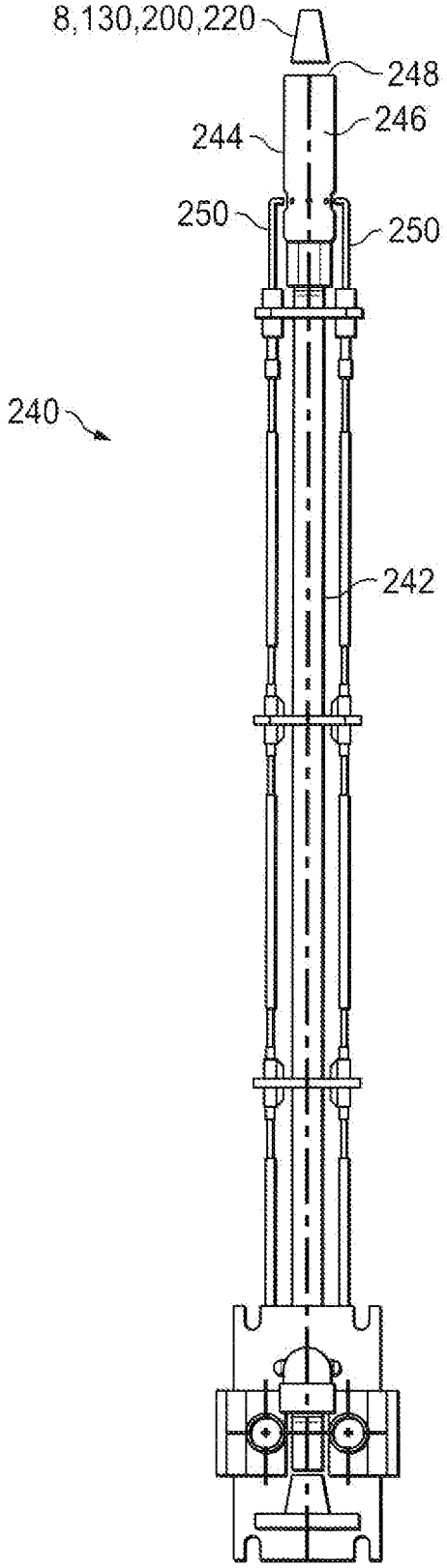
FIG. 18 is an elevational side view of a pilot burner assembly provided by the present invention.

An example of another embodiment of the inventive burner apparatus is the pilot burner 240 illustrated in FIG. 18. The pilot burner 240 comprises: (a) an air and fuel conduit 242 which extends, e.g., to a flare head at the top of a flare stack; (b) a pilot burner tip 244 on the distal end of the conduit 242; (c) a surrounding wall 246 of the pilot burner tip 244 which surrounds a flow passage for an air and fuel mixture and which has a discharge end 248; (d) one or more ignitors 250 for igniting the air and fuel mixture in the pilot burner tip 244; and (e) an inventive flow momentum enhancing device 8, 130, 200, or 220 of the same type described above which is positioned in, partially in, or forwardly of the flow passageway of the pilot burner tip 244. In the inventive pilot burner 240, the flow momentum enhancing device 8, 130, 200, or 220 operates to draw inert products of combustion from the combustion environment surrounding the tip 244 of the pilot burner 240.

Thus, the present invention is well adapted to carry out the objectives and attain the ends and advantages mentioned above as well as those inherent therein. While presently preferred embodiments and steps have been described for purposes of this disclosure, the invention is not limited in its application to the details of the preferred embodiments and steps. Numerous changes and modifications will be apparent to those in the art. Such changes and modifications are encompassed within this invention as defined by the claims. In addition, unless expressly stated, the phraseology and terminology employed herein are for the purpose of description and not of limitation.

What is claimed is:

1. A burner apparatus comprising:

a burner wall having a forward longitudinal end;

an air flow passageway, which extends through and is surrounded by the burner wall, for a combustion air stream comprising air or a mixture of air and fuel which travels through the air flow passageway, the air flow passageway having a forward discharge opening at the forward longitudinal end of the burner wall, and the forward discharge opening having an internal diameter or width; and a flow momentum enhancing device having a longitudinal axis, a rearward longitudinal end, a forward longitudinal end, and a surrounding exterior surface which extends from the rearward longitudinal end to the forward longitudinal end of the flow momentum enhancing device, the exterior surface of the flow momentum enhancing device having a maximum lateral outside diameter or width at a location which is rearward of the forward longitudinal end the flow momentum enhancing device and forward of the rearward longitudinal end of the flow momentum enhancing device, the exterior surface of the flow momentum enhancing device having an outside diameter or width at the forward longitudinal end of the flow momentum enhancing device which is less than the maximum lateral outside diameter or width, the exterior surface of the flow momentum enhancing device having an outside diameter or width at the rearward longitudinal end of the flow momentum enhancing device which is less than the maximum lateral outside diameter or width, and the rearward longitudinal end of the flow momentum enhancing device being positioned in the air flow passageway, at the forward discharge opening of the air flow passageway, or forwardly of the air flow passageway so that a forward flow path going forwardly from the rearward longitudinal end to the forward longitudinal end of the flow momentum enhancing device is defined outside of the flow momentum enhancing device for a flow path stream which comprises all or a portion of the combustion air stream which travels through the air flow passageway, wherein the forward flow path for the flow path stream travels over and in contact with the maximum lateral outside diameter or width of the exterior surface and then continues to travel along and in contact with the exterior surface from the location of the maximum lateral outside diameter or width to the forward longitudinal end of the flow momentum enhancing device such that, as the forward flow path for the flow path stream approaches the forward longitudinal end of the exterior surface, the exterior surface, and the forward flow path for the flow path stream traveling along and in contact with the exterior surface, converge inwardly with respect to the longitudinal axis of the flow momentum enhancing device, and the maximum lateral outside diameter or width of the exterior surface of the flow momentum enhancing device is from 1.5 to 5 inches less than the internal diameter or width of the forward discharge opening of the air flow passageway.

2. The burner apparatus of claim 1 wherein:

the flow momentum enhancing device has a longitudinal center point half way between the longitudinal rearward and forward ends of the flow momentum enhancing device and the location of the maximum lateral outside diameter or width of the exterior surface of the flow momentum enhancing device is located at or rearwardly of a lateral plane which extends through the longitudinal center point and is perpendicular to the longitudinal axis of the flow momentum enhancing device.

3. The burner apparatus of claim 2 wherein the exterior surface curves outwardly, with respect to the longitudinal axis of the flow momentum enhancing device, as the exterior surface extends from the rearward longitudinal end to the location of the maximum lateral outside diameter or width of the exterior surface; and the exterior surface curves inwardly, with respect to the longitudinal axis of the flow momentum enhancing device, as the exterior surface extends from the location of the maximum lateral outside diameter or width of the exterior surface to the forward longitudinal end of the flow momentum enhancing device.

4. The burner apparatus of claim 1 wherein:

the forward flow path is an exterior flow path and the flow path stream is an exterior flow path stream which comprises a first portion of the combustion air stream which travels through the air flow passageway;

the flow momentum enhancing device further comprises an interior passageway which extends longitudinally through the flow momentum enhancing device from the rearward longitudinal end to the forward longitudinal end of the flow momentum enhancing device; and the interior passageway of the flow momentum enhancing device defines an interior flow path through the flow momentum enhancing device for an interior flow path stream which comprises a second portion of the combustion air stream which travels through the air flow passageway, the second portion of the combustion air stream being different from the first portion of the combustion air stream.

5. The burner apparatus of claim 4 wherein:

the flow momentum enhancing device comprises a wall of the device which surrounds the interior passageway of the flow momentum enhancing device and extends from the rearward longitudinal end to the forward longitudinal end of the flow momentum enhancing device;

the wall of the device comprises (i) an exterior surface which is the exterior surface of the flow momentum enhancing device, (ii) a maximum lateral outside diameter or width of the exterior surface of the wall of the device which is the maximum lateral outside diameter or width of the exterior surface of the flow momentum enhancing device, and (iii) a location of the maximum lateral outside diameter or width of the exterior surface of the wall of the device which is the location of the maximum lateral outside diameter or width of the exterior surface of the flow momentum enhancing device; and the wall of the device has an interior surface, for the interior passageway, which extends from the rearward longitudinal end to the forward longitudinal end of the flow momentum enhancing device.

6. The burner apparatus of claim 5 wherein, as seen in a longitudinal cross-sectional view of the wall of the device, a rearward longitudinal end of the wall of the device is rounded.

7. The burner apparatus of claim 5 wherein:

the flow momentum enhancing device has a longitudinal center point half way between the longitudinal rearward and forward ends of the flow momentum enhancing device and the location of the maximum lateral outside diameter or width of the exterior surface of the wall of the device is located at or rearwardly of a lateral plane which extends through the longitudinal center point and is perpendicular to the longitudinal axis of the flow momentum enhancing device.

8. The burner apparatus of claim 7 wherein:

the exterior surface of the wall of the device curves outwardly, with respect to the longitudinal axis of the flow momentum enhancing device, as the exterior surface of the wall of the device extends from the rearward longitudinal end to the location of the maximum lateral outside diameter or width of the exterior surface of the wall of the device; and the exterior surface of the wall of the device curves inwardly, with respect to the longitudinal axis of the flow momentum enhancing device, as the exterior surface of the wall of the device extends from the location of the maximum lateral outside diameter or width of the exterior surface of the wall of the device to the forward longitudinal end of the flow momentum enhancing device.

9. The burner apparatus of claim 8 wherein a rearward segment of the interior surface of the wall of the device has an internal diameter or width at a forward end of the rearward segment which is less than an internal diameter or width of the interior surface of the wall of the device at the rearward longitudinal end of the flow momentum enhancing device.

10. The burner apparatus of claim 9 wherein the interior surface of the wall of the device curves inwardly with respect to the longitudinal axis of the flow momentum enhancing device as the interior surface of the wall of the device extends from the rearward longitudinal end of the flow momentum enhancing device to the forward end of the rearward segment of the interior surface.

11. The burner apparatus of claim 5 wherein, as seen in a longitudinal cross-sectional view of the wall of the device, the wall of the device has a symmetrical wing airfoil shape.

12. The burner apparatus of claim 4 further comprising a fuel discharge tip which is positioned (i) in the interior passageway of the flow momentum enhancing device, (ii) at a forward longitudinal opening of the interior passageway of the flow momentum enhancing device, or (iii) forwardly of the forward longitudinal opening of the interior passageway of the flow momentum enhancing device.

13. The burner apparatus of claim 1 wherein no portion of the burner wall extends forwardly beyond the forward longitudinal end of the burner wall and the rearward longitudinal end of the flow momentum enhancing device is positioned forwardly of the forward discharge opening of the air flow passageway so that no portion of the flow momentum enhancing device is surrounded by the burner wall.

14. The burner apparatus of claim 13 wherein the rearward longitudinal end of the flow momentum enhancing device is spaced from 0.25 to 6 inches forwardly of the forward discharge opening of the air flow passageway.

15. The burner apparatus of claim 1 wherein the burner wall is a refractory tile structure and the air flow passageway is a throat of the refractory tile structure.

16. The burner apparatus of claim 1 wherein the flow momentum enhancing device is centrally positioned with respect to the air flow passageway such that the longitudinal axis of the flow momentum enhancing device is coaxial with a central longitudinal axis of the air flow passageway.

17. The burner apparatus of claim 1 wherein the air flow passageway has a central longitudinal axis and the flow momentum enhancing device is positioned such that the longitudinal axis of the flow momentum enhancing device is laterally offset from and parallel to the central longitudinal axis of the air flow passageway.

18. The burner apparatus of claim 1 wherein the burner apparatus is a pilot burner and the burner wall is a pilot tip wall.

19. The burner apparatus of claim 1 further comprising a holding element thr the flow momentum enhancing device which extends longitudinally through at least a portion of the air flow passageway to the rearward longitudinal end of the flow momentum enhancing device.

20. The burner apparatus of claim 19 wherein the holding element is a segment of pipe or tubing.

21. A method of reducing $NO_x$ emissions from a burner apparatus comprising the steps of:

a) delivering a combustion air stream comprising air or a mixture of air and fuel through an air flow passageway which is surrounded by a burner wall of the burner apparatus, the burner wall having a forward longitudinal end, the air flow passageway having a forward discharge opening at the forward longitudinal end of the burner wall, and the forward discharge opening having an internal diameter or width and b) causing a flow stream comprising all or a portion of the combustion air stream flowing through the air flow passageway to flow forwardly along and in contact with a surrounding exterior surface of a flow momentum enhancing device wherein (i) the flow momentum enhancing device has a longitudinal axis, (ii) the flow momentum enhancing device has a rearward longitudinal end which is positioned in the air flow passageway, at the forward discharge opening of the air flow passageway, or forwardly of the air flow passageway, (iii) the surrounding exterior surface has a maximum lateral outside diameter or width at a location which is rearward of the forward longitudinal end the flow momentum enhancing device and forward of the rearward longitudinal end of the flow momentum enhancing device, (iv) the surrounding exterior surface has an outside diameter or width at the forward longitudinal end of the flow momentum enhancing device which is less than the maximum lateral outside diameter or width such that, as the surrounding exterior surface extends forwardly from the location of the maximum lateral outside diameter or width, at least a forward longitudinal portion of the surrounding exterior surface converges inwardly, with respect to the longitudinal axis of the flow momentum enhancing device, as the surrounding exterior surface approaches the forward longitudinal end of the flow momentum enhancing device, and (v) the surrounding exterior surface has an outside diameter or width at the rearward longitudinal end of the flow momentum enhancing device which is less than the maximum lateral outside diameter or width, wherein, in step (b), the flow stream is caused to flow forwardly over and in contact with the maximum lateral outside diameter or width of the surrounding exterior surface and then forwardly along and in contact with the inwardly converging forward longitudinal portion of the surrounding exterior surface to create a reduced pressure region around at least a portion of the surrounding exterior surface and/or at the forward longitudinal end of the flow momentum enhancing device which draws inert products of combustion into the reduced pressure region and the maximum lateral outside diameter or width of the exterior surface of the flow momentum enhancing device is from 1.5 to 5 inches less than the internal diameter or width of the forward discharge opening of the air flow passageway.

22. The method of claim 21 wherein:

the flow momentum enhancing device has a longitudinal center point half way between the longitudinal rearward and forward ends of the flow momentum enhancing device and the location of the maximum lateral outside diameter or width of the surrounding exterior surface is located at or rearwardly of a lateral plane which extends through the longitudinal center point and is perpendicular to the longitudinal axis of the flow momentum enhancing device.

23. The method of claim 22 wherein:

the surrounding exterior surface curves outwardly, with respect to the longitudinal axis of the flow momentum enhancing device, as the surrounding exterior surface extends from the rearward longitudinal end to the location of the maximum lateral outside diameter or width of the exterior surface; and the surrounding exterior surface curves inwardly, with respect to the longitudinal axis of the flow momentum enhancing device, as the surrounding exterior surface extends from the location of the maximum lateral outside diameter or width of the exterior surface to the forward longitudinal end of the flow momentum enhancing device.

24. The method of claim 21 wherein:

the flow stream is a first portion of the combustion air stream which travels through the air flow passageway the method further comprises causing a second portion of the combustion air stream, different from the first portion, to flow through a longitudinal interior passageway of the flow momentum enhancing device which extends from the rearward longitudinal end to the forward longitudinal end of the flow momentum enhancing device.

25. The method of claim 24 wherein:

the flow momentum enhancing device comprises a wall of the device which surrounds the interior passageway of the flow momentum enhancing device and extends from the rearward longitudinal end to the forward longitudinal end of the flow momentum enhancing device;

the wall of the device comprises an exterior surface which is the surrounding exterior surface of the flow momentum enhancing device; and the wall of the device has an interior surface, for the interior passageway, which extends from the rearward longitudinal end to the forward longitudinal end of the flow momentum enhancing device.

26. The method of claim 25 wherein, as seen in a longitudinal cross-sectional view of the wall of the device, a rearward longitudinal end of the wall of the device is rounded.

27. The method of claim 26 wherein a rearward end portion of the interior surface of the wall of the device curves inwardly with respect to the longitudinal axis of the flow momentum enhancing device as the interior surface of the wall of the device extends forwardly from the rearward longitudinal end of the flow momentum enhancing device.

28. The method of claim 25 wherein, as seen in a longitudinal cross-sectional view of the wall of the device, the wall of the device has a symmetrical wing airfoil shape.

29. The method of claim 21 wherein no portion of the burner wall extends forwardly beyond the forward longitudinal end of the burner wall, and the rearward longitudinal end of the flow momentum enhancing device is spaced from 0.5 to 6 inches forwardly of the forward discharge opening of the air flow passageway such that no portion of the flow momentum enhancing device is surrounded by the burner wall.

30. A burner apparatus comprising:

a burner wall having a forward longitudinal end;

an air flow passageway, which extends through and is surrounded by the burner wall, for a combustion air stream comprising air or a mixture of air and fuel which travels through the air flow passageway, the air flow passageway having a forward discharge opening at the forward longitudinal end of the burner wall, and the forward discharge opening having an internal diameter or width; and a flow momentum enhancing device having a longitudinal axis, a rearward longitudinal end, a forward longitudinal end, and a surrounding exterior surface which extends from the rearward longitudinal end to the forward longitudinal end of the flow momentum enhancing device, the exterior surface of the flow momentum enhancing device having a maximum lateral outside diameter or width at a location which is rearward of the forward longitudinal end the flow momentum enhancing device, the exterior surface of the flow momentum enhancing device having an outside diameter or width at the forward longitudinal end of the flow momentum enhancing device which is less than the maximum lateral outside diameter or width, the rearward longitudinal end of the flow momentum enhancing device being positioned in the air flow passageway, at the forward discharge opening of the air flow passageway, or forwardly of the air flow passageway so that a flow path is defined outside of the flow momentum enhancing device for a flow path stream which comprises all or a portion of the combustion air stream which travels through the air flow passageway, wherein the flow path for the flow path stream travels over and in contact with the maximum lateral outside diameter or width of the exterior surface and then continues to travel along and in contact with the exterior surface from the location of the maximum lateral outside diameter or width to the forward longitudinal end of the flow momentum enhancing device such that, as the flow path for the flow path stream approaches the forward longitudinal end of the exterior surface, the exterior surface, and the flow path for the flow path stream traveling along and in contact with the exterior surface, converge inwardly with respect to the longitudinal axis of the flow momentum enhancing device, the burner apparatus further comprising a holding element for the flow momentum enhancing device which extends longitudinally through at least a portion of the air flow passageway to the rearward longitudinal end of the flow momentum enhancing device, and a mounting base secured to or rearwardly of the burner wall, the mounting base comprising a ring, to which a rearward longitudinal end of the holding element is attached, and a plurality of support arms which extend outwardly from the ring.

31. A burner apparatus comprising:

a burner wall having a forward longitudinal end;

an air flow passageway, which extends through and is surrounded by the burner wall, for a combustion air stream comprising air or a mixture of air and fuel which travels through the air flow passageway, the air flow passageway having a forward discharge opening at the forward longitudinal end of the burner wall; and a flow momentum enhancing device having a longitudinal axis, a rearward longitudinal end, a forward longitudinal end, and an interior passageway which extends longitudinally through the flow momentum enhancing device from the rearward longitudinal end to the forward longitudinal end of the flow momentum enhancing device, the flow momentum enhancing device further comprising a device wall which surrounds the interior passageway of the flow momentum enhancing device and extends from the rearward longitudinal end to the forward longitudinal end of the flow momentum enhancing device, the device wall having (i) an exterior surface which extends from the rearward longitudinal end to the forward longitudinal end of the flow momentum enhancing device and (ii) an interior surface, for the interior passageway, which extends from the rearward longitudinal end to the forward longitudinal end of the flow momentum enhancing device, the exterior surface of the device wall having a maximum lateral outside diameter or width at a location which is rearward of the forward longitudinal end of the flow momentum enhancing device, the exterior surface of the device wall having an outside diameter or width at the forward longitudinal end of the flow momentum enhancing device which is less than the maximum lateral outside diameter or width, the rearward longitudinal end of the flow momentum enhancing device being positioned in the air flow passageway, at the forward discharge opening of the air flow passageway, or forwardly of the air flow passageway, the interior passageway of the flow momentum enhancing device defining a flow path through the flow momentum enhancing device for a flow path stream which comprises all or a portion of the combustion air stream which travels through the air flow passageway, and as seen in a longitudinal cross-sectional view of the device wall, the device wall has a non-symmetrical wing airfoil shape.

32. A method of reducing $NO_x$ emissions from a burner apparatus comprising the steps of:

a) delivering a combustion air stream comprising air or a mixture of air and fuel through an air flow passageway which is surrounded by a burner wall of the burner apparatus, the burner wall having a forward longitudinal end, the air flow passageway having a forward discharge opening at the forward longitudinal end of the burner wall, and the forward discharge opening having an internal diameter or width and b) causing a flow stream comprising all or a portion of the combustion air stream flowing through the air flow passageway to flow along and in contact with a surrounding exterior surface of a flow momentum enhancing device wherein (i) the flow momentum enhancing device has a longitudinal axis, (ii) the flow momentum enhancing device has a rearward longitudinal end which is positioned in the air flow passageway, at the forward discharge opening of the air flow passageway, or forwardly of the air flow passageway, (iii) the surrounding exterior surface has a maximum lateral outside diameter or width at a location which is rearward of the forward longitudinal end the flow momentum enhancing device, and (iv) the surrounding exterior surface has an outside diameter or width at the forward longitudinal end of the flow momentum enhancing device which is less than the maximum lateral outside diameter or width such that, as the surrounding exterior surface extends forwardly from the location of the maximum lateral outside diameter or width, at least a forward longitudinal portion of the surrounding exterior surface converges inwardly, with respect to the longitudinal axis of the flow momentum enhancing device, as the surrounding exterior surface approaches the forward longitudinal end of the flow momentum enhancing device, wherein, in step (b), the flow stream is caused to flow over and in contact with the maximum lateral outside diameter or width of the surrounding exterior surface and then along and in contact with the inwardly converging forward longitudinal portion of the surrounding exterior surface to create a reduced pressure region around at least a portion of the surrounding exterior surface and/or at the forward longitudinal end of the flow momentum enhancing device which draws inert products of combustion into the reduced pressure region, the flow stream is a first portion of the combustion air stream which travels through the air flow passageway, the method further comprises causing a second portion of the combustion air stream, different from the first portion, to flow through a longitudinal interior passageway of the flow momentum enhancing device which extends from the rearward longitudinal end to the forward longitudinal end of the flow momentum enhancing device, the flow momentum enhancing device comprises a wall of the device which surrounds the interior passageway of the flow momentum enhancing device and extends from the rearward longitudinal end to the forward longitudinal end of the flow momentum enhancing device, the wall of the device comprises an exterior surface which is the surrounding exterior surface of the flow momentum enhancing device, the wall of the device has an interior surface, for the interior passageway, which extends from the rearward longitudinal end to the forward longitudinal end of the flow momentum enhancing device, and as seen in a longitudinal cross-sectional view of the wall of the device, the wall of the device has a non-symmetrical wing airfoil shape.

* * * * *